US008138692B2

(12) United States Patent
Macdonald-Bradley

(10) Patent No.: US 8,138,692 B2
(45) Date of Patent: Mar. 20, 2012

(54) EPICYCLOTRON

(76) Inventor: Christopher James Macdonald-Bradley, Bedworth (GB)

( * ) Notice: Subject to any disclaimer, the term of this patent is extended or adjusted under 35 U.S.C. 154(b) by 844 days.

(21) Appl. No.: 12/183,029

(22) Filed: Jul. 30, 2008

(65) Prior Publication Data

US 2009/0033249 A1 Feb. 5, 2009

(51) Int. Cl.
*H01J 7/00* (2006.01)
*H01J 23/00* (2006.01)

(52) U.S. Cl. ..... 315/501; 315/500

(58) Field of Classification Search ..... 315/500, 315/501, 503, 504, 505, 506, 507
See application file for complete search history.

*Primary Examiner* — Douglas W Owens
*Assistant Examiner* — Minh D A

(57) ABSTRACT

A magnetic field crosses non-uniform rotating electric radial fields which are generated between a central electrode and a series of circumferential outer electrodes. Synchronous charging and partial discharging is applied to the outer electrodes, generating a rotating non-axisymmetric field. Charged particles may then be accelerated and held in a circular orbit, regulated by the magnitude and frequency of the charging of the electrodes, with a radius given by $Bqwr=Eq+mw^2r$. The circular beam of particles so formed may be used for a variety of applications, which also includes fusion energy applications due to the high kinetic energy possible in the apparatus and the mechanism of energy recovery of scattered particles. Isotopic separation by charge to mass ratio is also possible, the device being essentially a cyclotron with radial electrodes. A four-state 'quad-stable' formed from four inter-connected NOR-gate based flip-flops is also disclosed which provides the logic sequencing for the control of the synchronous charging cycles for embodiments of the invention.

7 Claims, 16 Drawing Sheets

(i)

(ii)

EPICYCLOTRON

TECHNICAL FIELDS OF THE INVENTION

The present invention is a means to accelerate charged particles into a circular beam and maintain them in that state. They may then be drawn off as a linear beam. Such beams are ubiquitous amongst high technology industries and are used for etching, deposition, plasma generation and a variety of other applications.

The range of particle energies that the present invention is capable of is of sufficient magnitude that it may also be used in high energy particle physics including fusion power applications. One application in fusion physics is to fuse the beam nucleii with those of the prevailing background medium.

Another particular use for the device is as a means for elemental ion mass spectrometry and separation. It is essentially a cyclotron with radial electrodes rather than circumferential electrodes and therefore serves many such functions that the cyclotron is used for, but with efficiency advantages.

BACKGROUND TO THE INVENTION

The present invention accelerates ions into a circular beam and may keep them there indefinitely by inputting only that much energy that is necessary to mitigate Coulombic scattering and ionising collisions. This is an efficiency gain over existing ion-beam forming methods potentially sufficient to enable viable beam-fusion net energy gains not otherwise possible with other beam methods. The present invention also avoids the need for ion-producing modules or elements, but generates ions within its normal operation by accelerating background ions and electrons and then using those to form further ions.

It is similar to the cyclotron invention of Ernest Lawrence (U.S. Pat. No. 1,948,384). In the cyclotron, a magnetic field is applied across a space in which ions are accelerated in a plane orthogonal to the magnetic field by synchronous radio frequency (RF) switching of circumferential electric fields between electrodes. Work is done on ions as they pass, and thus accelerate, across the space between the electrodes by the electric fields.

In the cyclotron, the centripetal acceleration of an ion is balanced to the RF electric field frequency. The magnetic force Bqwr (B=magnetic field, w=frequency, r=ion's distance to centre of rotation, q=ion's charge) balances the radial force arising from the centripetal acceleration, $mw^2r$ (m=ion mass). Therefore the ions rotation is described by $mw^2r=Bqwr$.

Solutions exist independently of r providing mw=Bq. Consequently, ions may be incrementally accelerated by repeatedly passing across circumferential electric fields. Each time the ion gains kinetic energy so its radius freely increases. It does so until it reaches a given design radius and is then removed from the device by various means. Many such ions undertake the same process together forming a beam exiting the device.

In the present invention, the essential difference to the cyclotron is that RF switching occurs between multiple electrodes that are oriented radially with respect to a central electrode at the axis of ion rotation. Ions therefore gain circumferential velocity by firstly accelerating radially due to work done on them by those electric fields, then are subject to the magnetic cross-product force that transforms radial into circumferential momentum.

In the cyclotron the centripetal acceleration of the ion mass balances the magnetic force without regard to the radius and, as energy is gained, it freely increases its radius and so incrementally spirals outwards. Thus, it may appear counter-intuitive that for fixed-radius orbital stability a radial electric field must be configured such that it tends to accelerate ions away from the centre of rotation and oppose the magnetic field forces, but nonetheless is the case.

This configuration of electric fields is essentially that found in Penning traps used for ion storage. The present invention represents a planar complex projection of a Penning trap with the end cap electrodes translated into a central electrode, and with sychronised RF cycling more akin to a Paul trap. However, whereas the Penning trap has axial stability from the fields generated by the end caps, in the present invention all electrodes are in the same plane. Axial stability is therefore dealt with by other means in the present invention.

It will be explained later why an inward directed electric force results in an unstable system, but the outward electric force presents certain difficulties that are resolved by elements of other inventions. An orbiting ion bound within a radially outward electric force in combination with the magnetic force is self-stabilising for small perturbations about its orbit both spatially and temporally. However for larger perturbations, e.g. close nuclear scattering events, an ion disturbed from the control of the magnetic field will be strongly accelerated radially outward due to this imposed electric field. The energy of the ion would be lost from the circular beam if it were not recirculated back into the confines of the magnetic and electric fields once again.

Therefore, certain embodiments of the present invention also share commonality with a second set of inventions, designed for net fusion energy gain, from Philo Farnsworth (U.S. Pat. No. 3,386,883 and others). These devices operate by recirculation of positive ions back-and-forth through an electrode structure held at a negative potential to the surrounding potentials. These prior patents use spherical electrodes as a means for beam focussing. This is not the case for the present invention in which the outer electrodes are planar, but reciprocation of ions across the electrodes of the present invention, until such time as they are recovered into the circular beam, would improve the efficiency of the recovery of scattered ions. Further, in the present invention a final outer pair of concentric grids about the entire assembly may be employed to recirculate any other ions scattered at a sufficiently oblique angle that they pass the outer electrodes and would otherwise exit the device. Such structures in the present invention should therefore be as transparent to the passage of ions as practical, namely should be generally mesh or wire structures, for embodiments requiring maximum efficiency of operation.

A static radial electric field with crossed magnetic field will retain ions already in a stable, unperturbed, circular orbit. The present invention is principally based on the idea of time varying electric fields so as to keep and recover ions into a circular orbit even after perturbations. This requires phased electric fields synchronised with the ion orbit and therefore shares common ideas with rotating magnetic fields of electric motors, whereas the present invention uses rotating electric fields. George Meacham's invention, (US2005/0249324), also aims to accomplish net fusion energy gain by means of synchronised electric fields but this invention lacks a central electrode. In the present invention the central electrode forms a fixed rotation point for the ions but also provides the radial electric field which performs work on ions in the device thereby accelerating them to the speeds required to be held in the circular orbits.

Rolf Stenbaka's invention, (U.S. Pat. No. 4,853,173), aims for net fusion energy gain with an ion beam entering a storage ring composed of an outward directed radial electric field and orthogonal magnetic field, as per the present invention. This invention aims to collapse the storage ring to a central point by switching off the electric field. In the present invention ions are held permanently in a circular orbit by continuous electric field rotation, and fusion is intended between the fast beam ions and the background medium. Again, this has no central electrode so ions must be accelerated into this device by other means, namely an ion gun.

This configuration of radial electric field crossed by a magnetic field is therefore well-known, and there is extensive published research covering rotating plasmas in a EXB configuration. But the present invention rotates the whole electric field within a set of dissimilarly and periodically charged electrodes working in synchrony with rotating particles, rather than relying on the homopolar EXB principle that is common to most investigations into rotating plasmas to date.

SUMMARY OF THE INVENTION

A device embodying the invention consists of a central axial electrode held to a generally positive potential with respect to a set of outer electrodes, each approximating to a surface of a cylindrical sector (so generally forming circular arcs in section) positioned co-axially and circumferentially about it. The outer electrodes are held at various potentials and are negatively charged then discharged (or partially discharged), with respect to the potential of the central electrode, in a synchronous manner. All are set within a pervasive magnetic field oriented generally axially with the electrodes.

Any positive ions within a fluid around the central electrode would accelerate outwards with the prevailing radial electric field. As they do so they come under the influence of the magnetic field which translates the ion's radial momentum into a circumferential momentum, described by F=Bqv, the momentum exchange being reacted through the magnetic apparatus which is fixed, as are the electrodes.

Initially, the ion's trajectory resulting from this momentum transfer does not immediately bring it into a circular orbit about the central electrode, but instead heads generally towards the most negatively charged electrode. But the prevailing radial electric field then rotates by the discharge of the electrode that the ion is heading towards and the charging up of the next electrode disposed in the direction of the ion's trajectory. This has two cumulative effects; the ion comes under the influence of an electric field which has a component towards the next electrode circumferentially around the device, but also the magnetic field force experienced by the ion is no longer opposed by the peak radial electric force. The ion trajectory thus takes on a tighter radius which corrects the initial path that took the ion away from the central electrode, and may thereafter settle into a stable circular orbit.

If it attains an orbit such that it maintains a radial position and speed which keeps it at the same rotational frequency as the electric field then that field would appear 'uniform' to that particle and it would persist in that radius indefinitely unless disturbed.

If the ion has not attained a stable orbit in this initial acceleration it would lag behind that peak electric field rotation. It would then experience a stronger magnetic field as it is no longer opposed by that electric field and would take up a tighter radius. As it does so, it will execute an orbit with a smaller radius than it would otherwise perform if it were still in the peak electric field. In following a trajectory about a smaller radius it may catch up with the peak electric field. That field will then perform more work on that ion. The ion may still have insufficient velocity to maintain synchronisation with the electric field, but each time it lags behind its radius will tighten, it will catch up with the peak electric field and extract yet more energy from it until it attains sufficient energy to maintain synchronicity.

Alternatively, if the ion is so slow that the electric field completes a whole rotation before the ion has a chance to catch up with the peak field then radial work will still be done on the ion during the period that the ion is within that peak electric field as it overtakes the ion.

The device can therefore accelerate stationary ions up to having sufficient energy to form a fast ion in the main circular beam and can therefore also re-accelerate any intermediate ions that have slowed down for any reason.

Ions in the beam may be scattered in Coulomb scattering events. They may then be accelerated along a significantly radial trajectory due to the electric field orientation. These would likely impact the outer electrodes if they were solid. Constructing the outer electrodes in a manner that makes them generally permeable to the passage of ions would allow most ions to pass through, be decelerated by the field it generates, then be re-accelerated back through the outer electrode and on towards the circular beam where it will re-enter this acceleration process until it once again forms part of the beam. This recirculation process has no net energy cost. As the particle is slowed by the electric field, so it does work on that field. As it is re-accelerated by the field and work is done on it, so that energy is recovered. An ensemble of such particles variously recirculating about the electrodes within the field therefore have no effect on the voltage potential being held across those electrodes and has no influence on the power supply generating that voltage.

Various complications can then arise if the physical dimensions involved and electric field rotation periods create mismatches in this timing of events. In the worst case, an ion is accelerated towards an outer electrode which discharges at the exact moment that it passes through it. In this case the ion is likely to have ample energy to fully exit the device. Therefore, two outer screens, one nested inside the other, may enclose the whole device continuously and are held steady with given voltages, the potential difference between the two being chosen such that any ions likely to pass the inner of the screens will be decelerated by the field between the inner and outer screen and thus re-accelerated and recirculated back into the device.

Ions will still respond to the magnetic field throughout these transits and will continue to generally rotate in the same sense as other ions whereas electrons will tend to take on ExB drift motions and not tend to move radially within the device. This is because the gyroradius of the ions whilst in the rotating electric field peak becomes the orbital radius of the circular beam, and thus there is no space within the device for ions to execute ExB drifts, whereas the gyroradius of the electrons is small compared with the dimensions of the device and so they will execute ExB drifting circumferentially with only a small radial transport flux to the relatively-positive inner screen.

Perturbations and scattering of ions axially from the plane of the beam orbit are not managed by the fields between the inner and outer electrodes. A number of solutions exist, the preferred embodiment being to hold the inner screen at the same potential as the central electrode, thus creating a repulsive force away from the inner screen and towards the most negatively charged outer electrode, so that if an ion is not central to the field generated by the inner screen, which is also generally the plane of orbital rotation of the beam, then it will experience an axial component of electric field force that restores it to the plane of orbital rotation.

INTRODUCTION TO DRAWINGS

Examples of the invention will now be described by referring to the accompanying drawings:

The labels for the various parts is consistent throughout all the figures where those parts serve identical functions.

FIG. 1 depicts an essential embodiment of the present invention. A central electrode, A, is held to a generally positive potential with respect to outer electrodes, C1, C2, C3 and C4 creating a generally radially outward electric force, shown as E, on an ion, I. Electrodes C3 and C4 are depicted to be more negatively charged than C1 and C2 and this creates a non-uniform, non-axisymmetric electric field. A pervasive magnetic field, B, passes orthogonally through the electric field. Whilst the ion, I, is in motion around A it experiences magnetic and electric forces that balance its centripetal motion, thereby stabilising it in its orbit about A.

Figure 6:
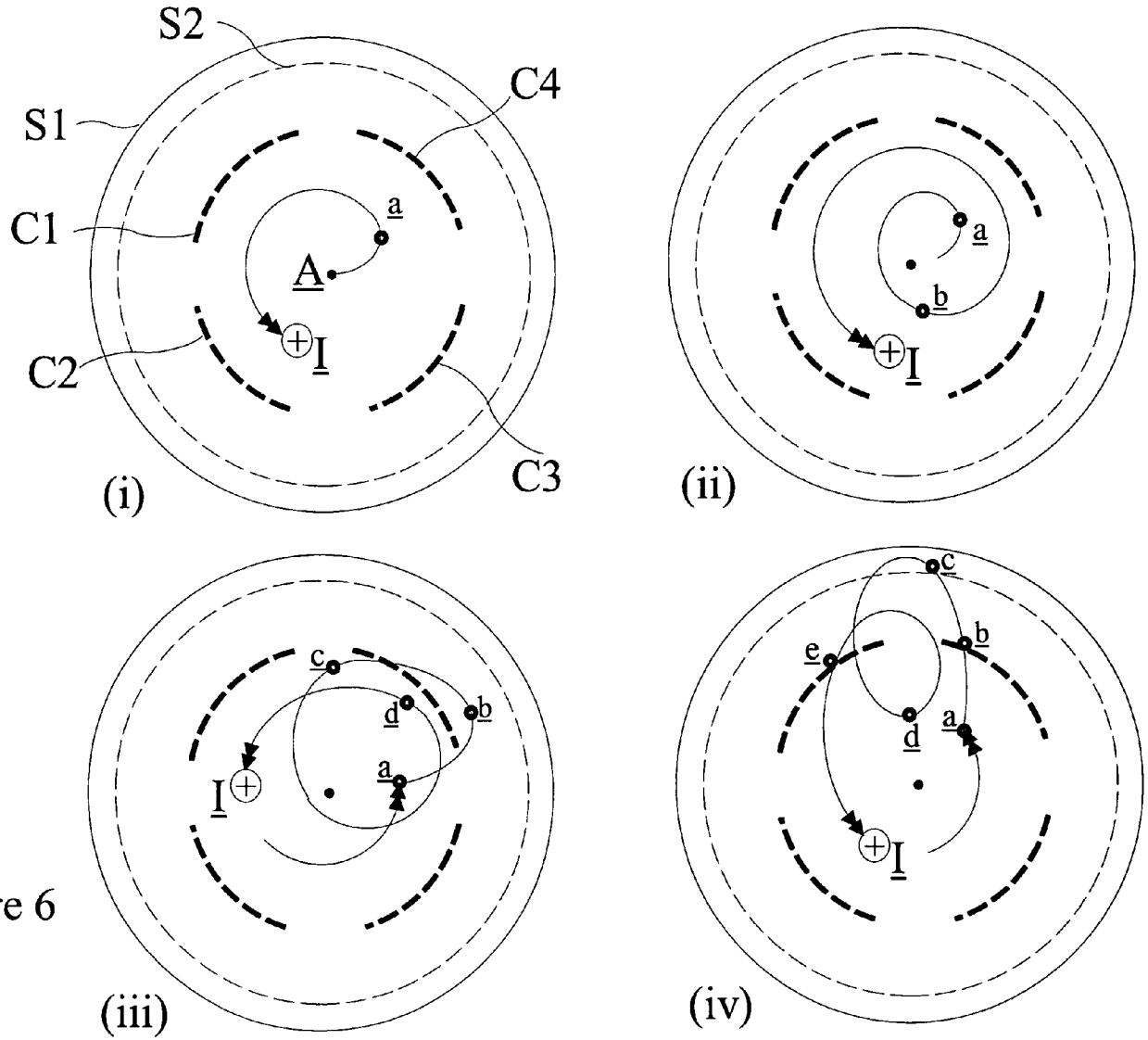

FIG. 6 shows the essential electrodes as previous figures and includes two screens, S1 and S2. S1 is held to a positive potential above S2 so that any ions passing the inner screen, S2, are decelerated and accelerated back again generally towards the axial centre. Examples of the paths that an ion, I, might take whilst being accelerated and manipulated by the electric and magnetic fields are shown, and depicts the principle that with this configuration the ions always end up back on a stable orbit whatever starting energy they might have and whatever disruptions they might experience. (The structures are labelled for diagram (i) only, but are identical for the other diagrams within the figure.)

Figure 7:
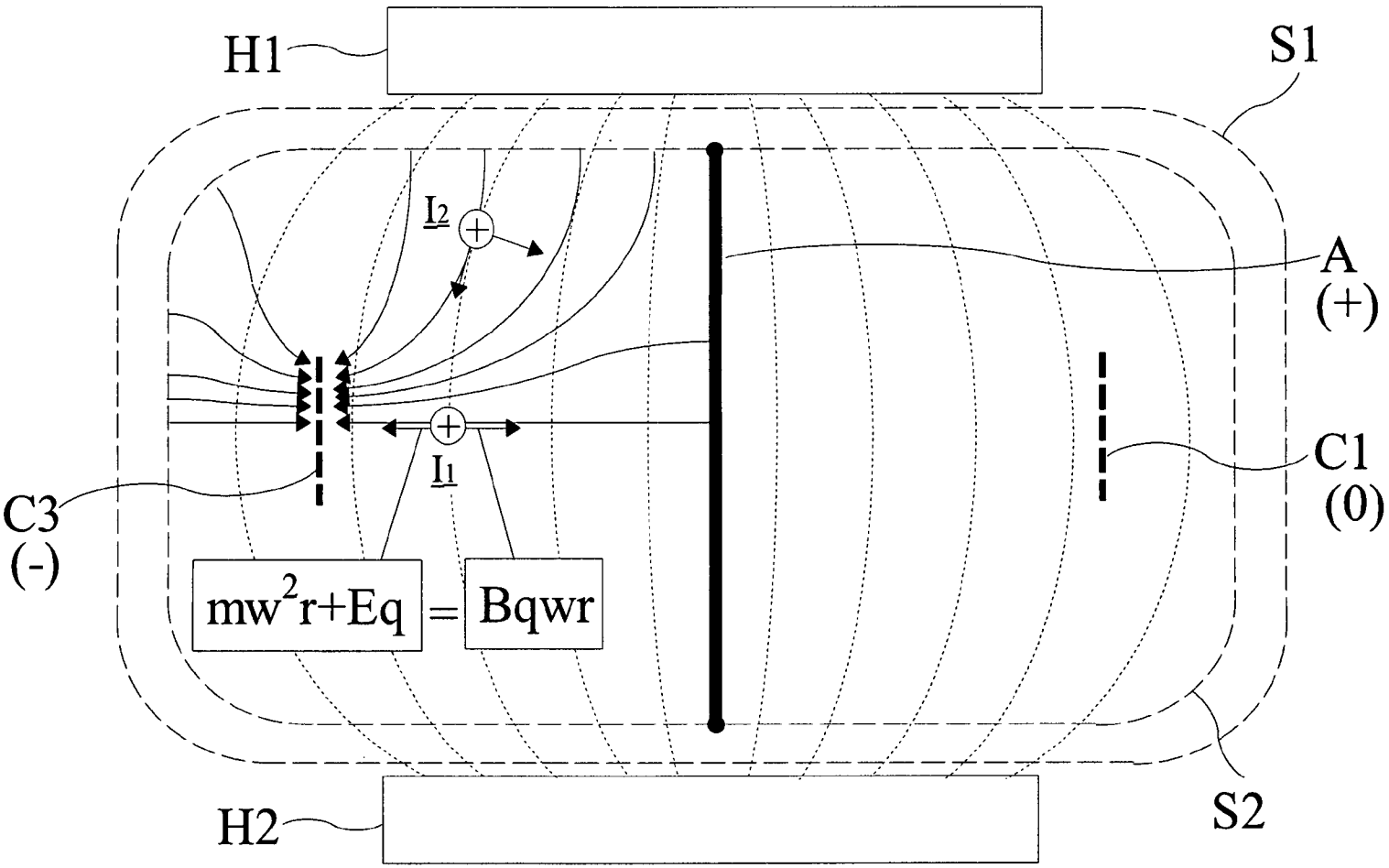

FIG. 7 shows a full embodiment of the invention with essential parts. The screens, S1 and S2 are shown along with the outer electrodes C3 and C1 (C2 and C4, as depicted in other figures, not shown in this section view). Ion I1 is already in a stable orbit about the central electrode, A, while I2 that is not in the stability orbit experiences electric and magnetic field components that direct it back to the plane of that stable orbit. Electrically connecting A to S2 therefore provides an axial confinement back to the intended orbital plane. Magnets H1 and H2 provide the magnetic field across the device.

Figure 8:
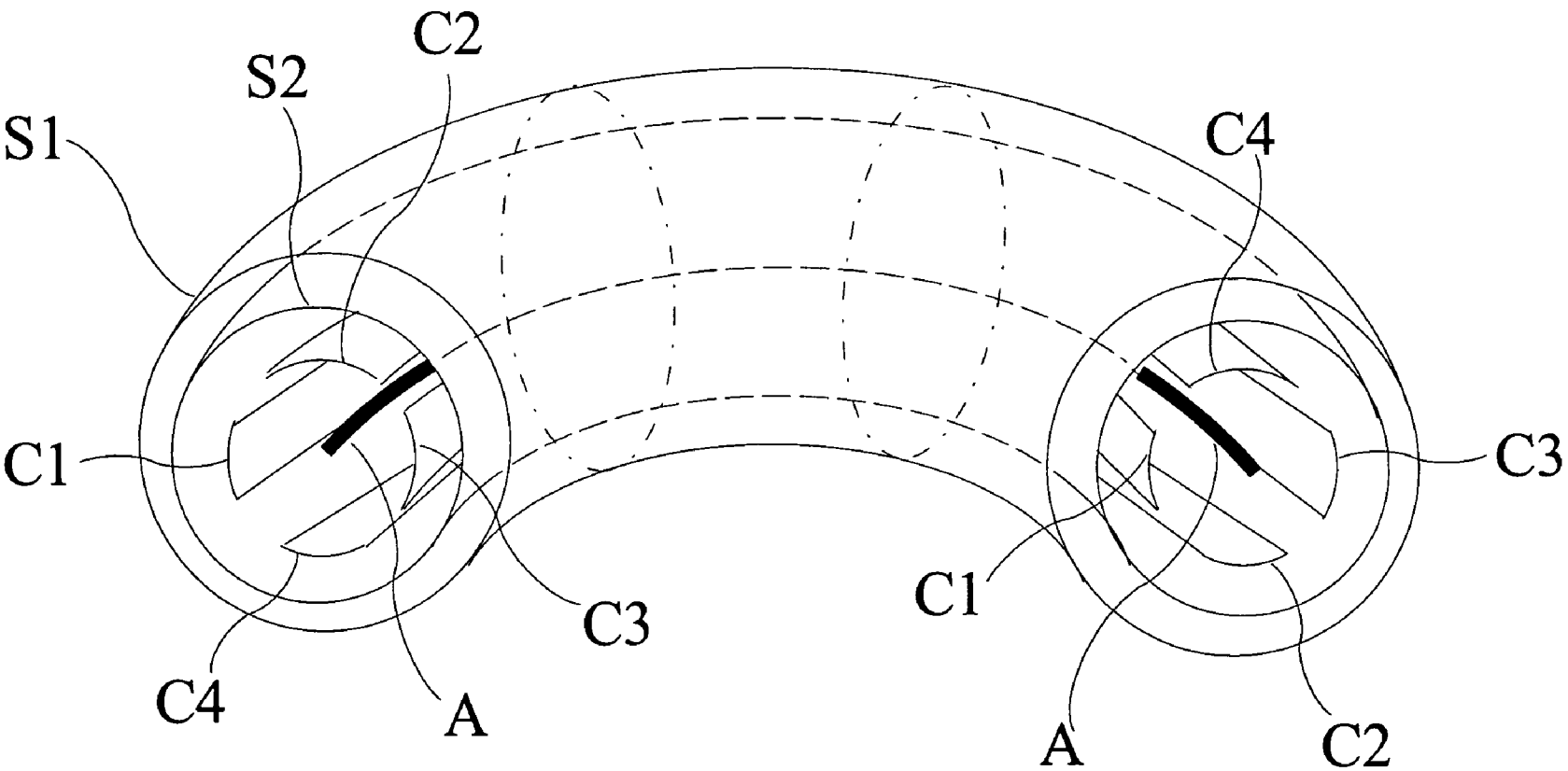

FIG. 8 shows a mid-sectioned view of an axially extruded form of FIG. 7 which is brought full back on itself to form a toroidal structure. All electrodes are commonly labelled as per FIG. 7.

Figure 9:
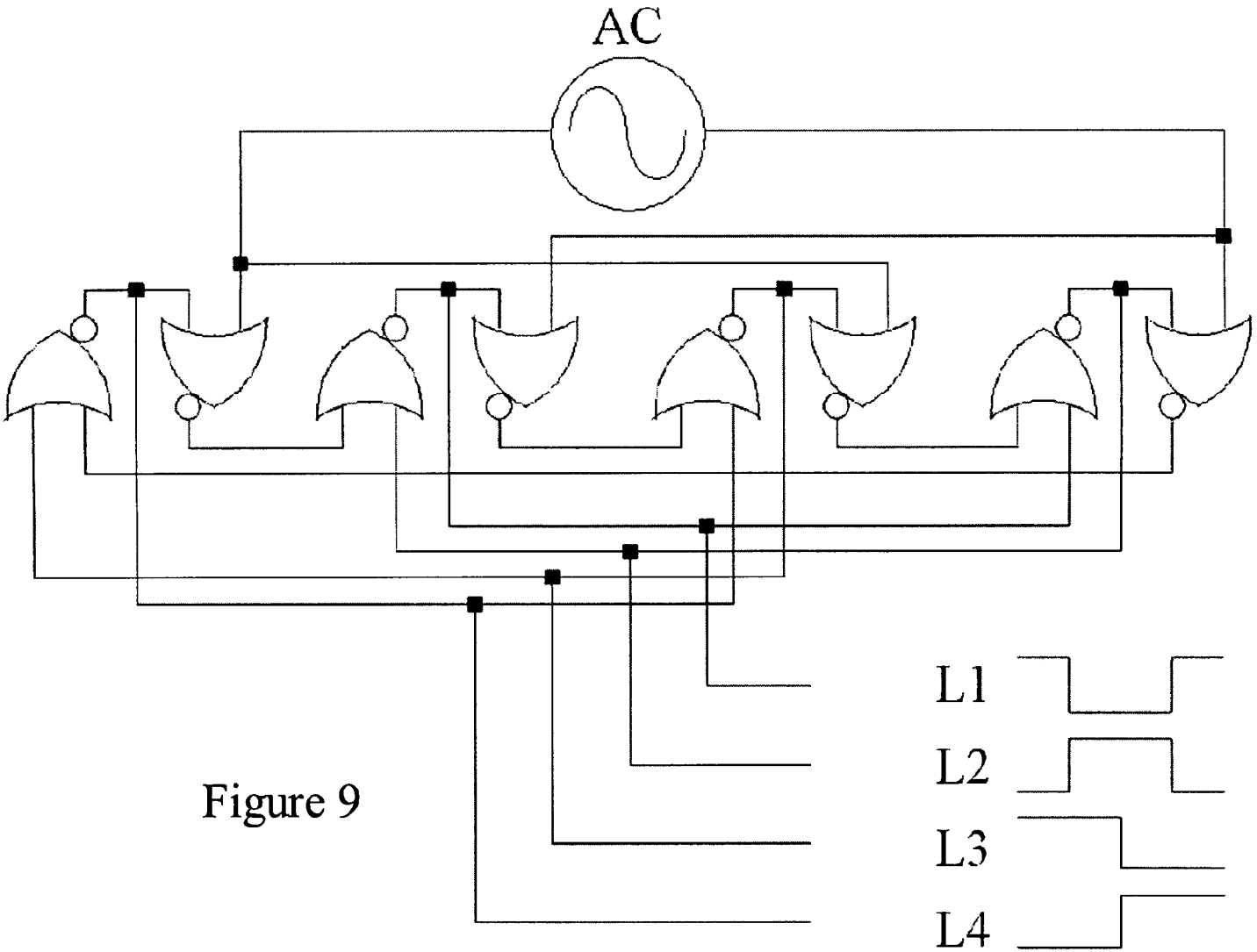

FIG. 9 shows a series of 8 interconnected NOR gates configures to form a 'quad-stable'. This is a logic circuit that can only adopt one of four states, and that switches sequentially between those states on the leading and falling edges of an input signal, AC, and with 4 phase-shifted outputs, L1, L2, L3 and L4, that can control the circuits necessary to implement an embodiment of the invention configured with multiples of 4 outer electrodes.

Figure 10:
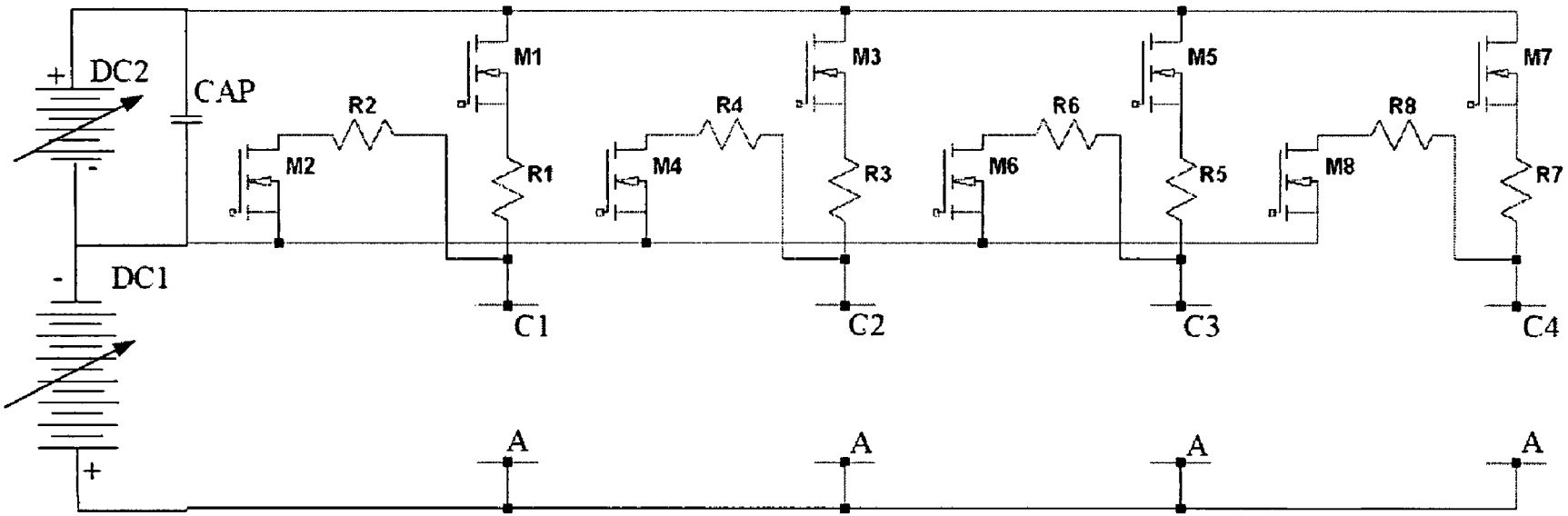

FIG. 10 shows an example circuit in which the gates of 8 MOSFETs are driven by switching controls, such as those of L1, L2, L3 and L4 of FIG. 9. This provides switching of power supplies, DC1 and DC2, that can charge and discharge the electrode structures C1, C2, C3 and C4 according to the synchronous waveforms applied to the MOSFET's gates.

Figure 11:
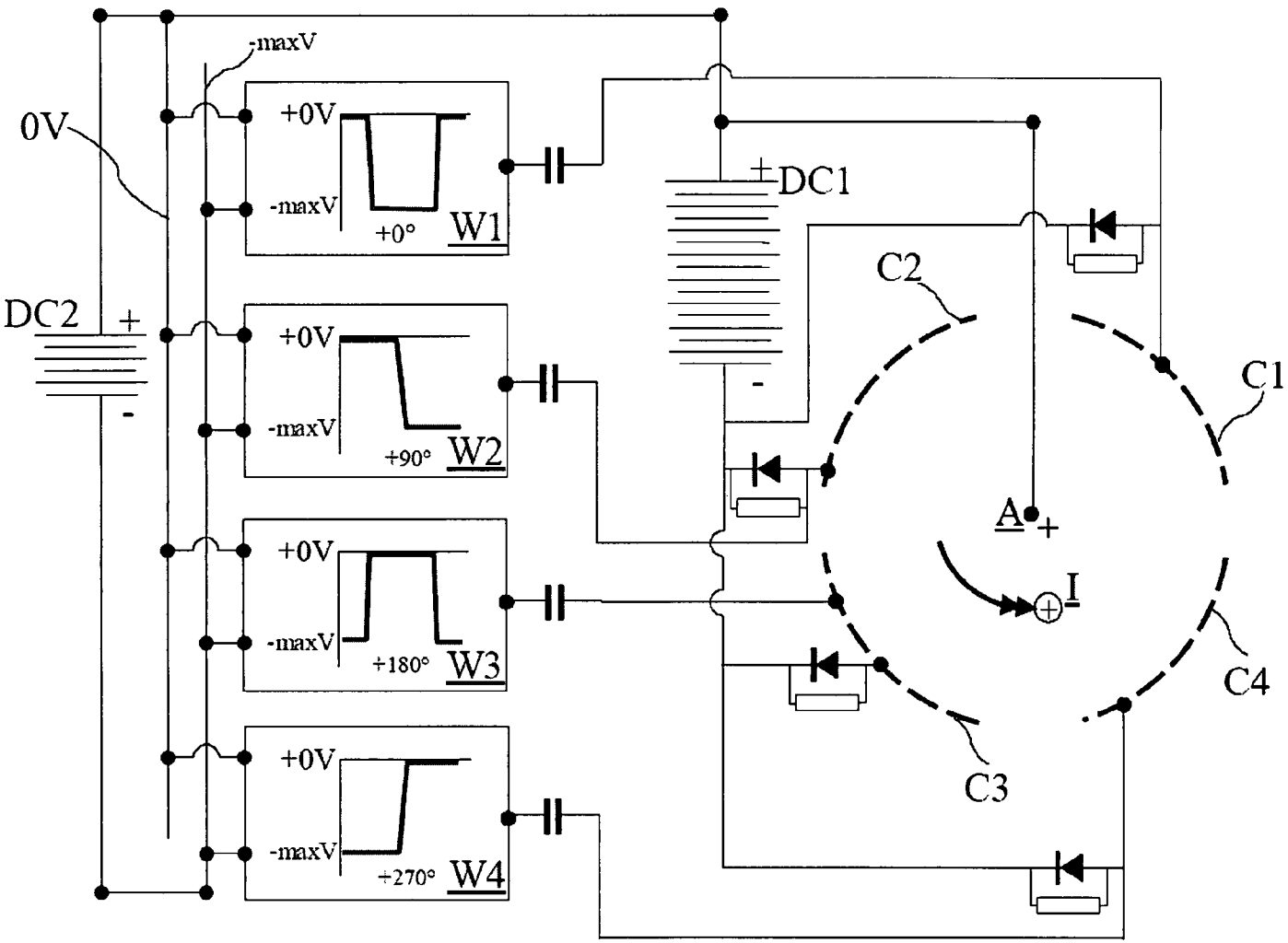

FIG. 11 shows an alternative strategy to connect to the outer electrodes to that of FIG. 10 (the same labelling is used) and shows charge pumps, shown by the parallel diode and resistor circuits (standard symbols used) which allows the waveform power outputs to be capacitively DC isolated from the outer electrodes.

Figure 1:
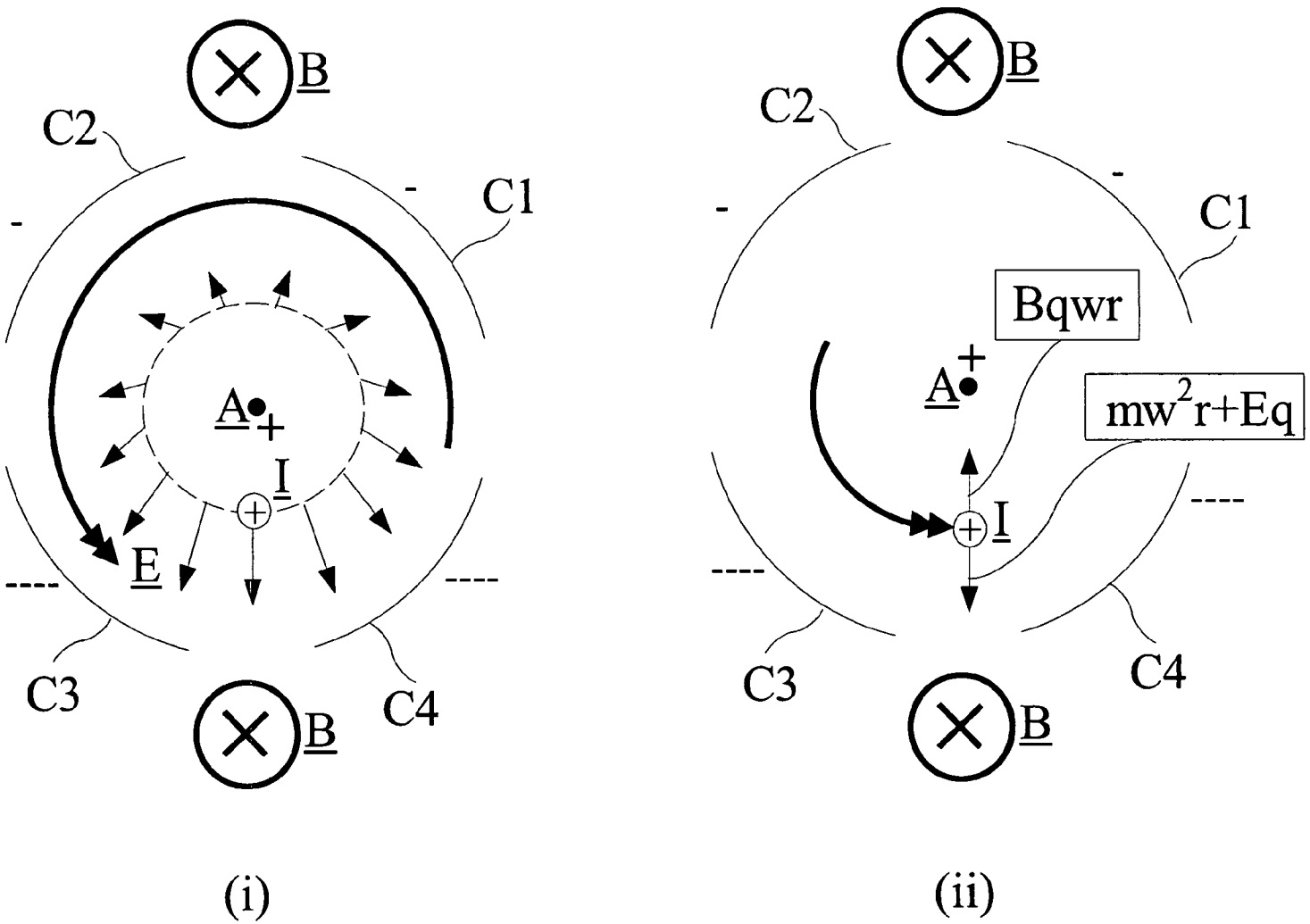
Figure 2:
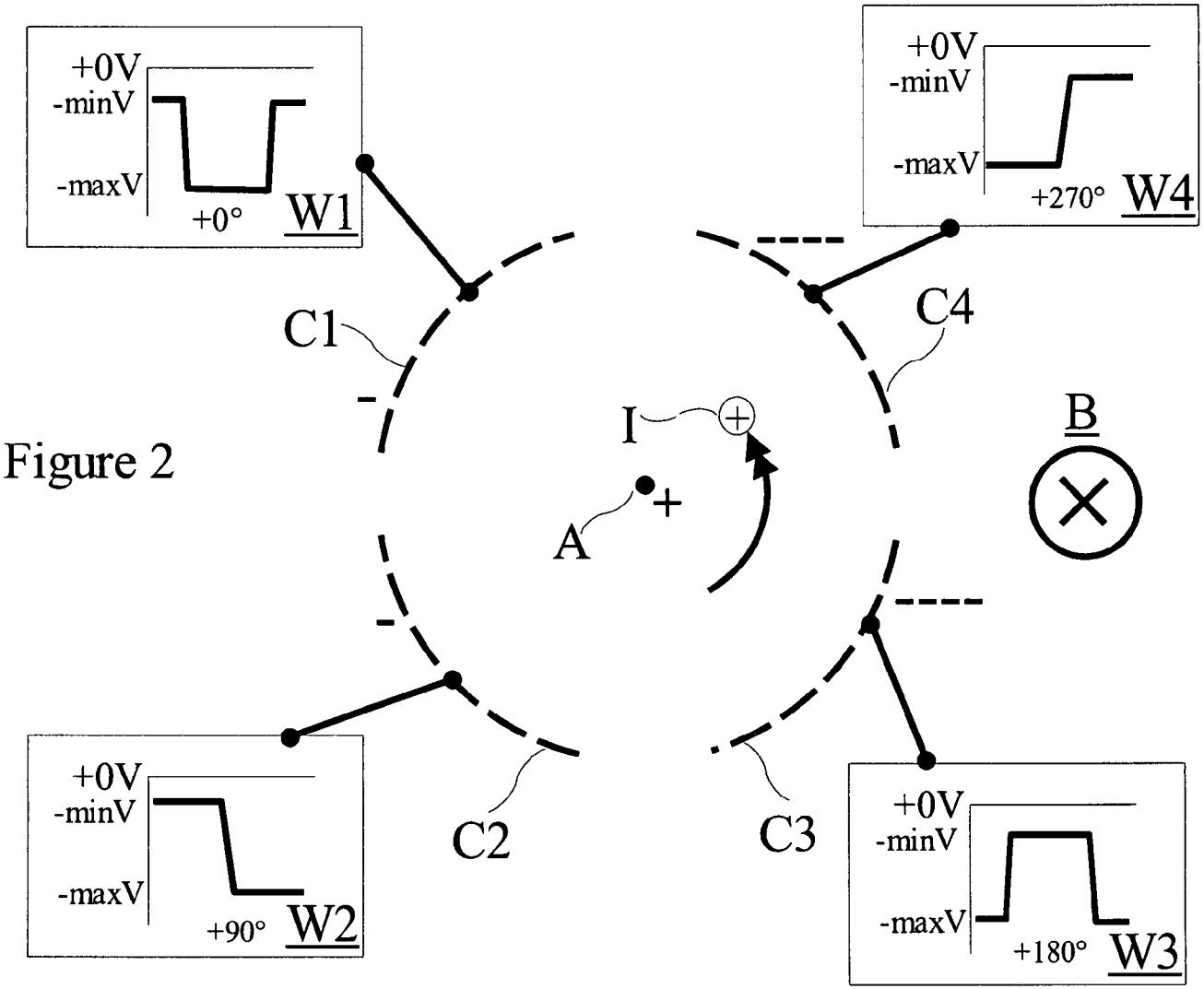
FIG. 2 depicts the elements shown in FIG. 1 along with the driving waveforms, W1, W2, W3 and W4, that are periodic alternating voltages at different phases applied to the outer electrodes which create a rotating electric field.
Figure 3:
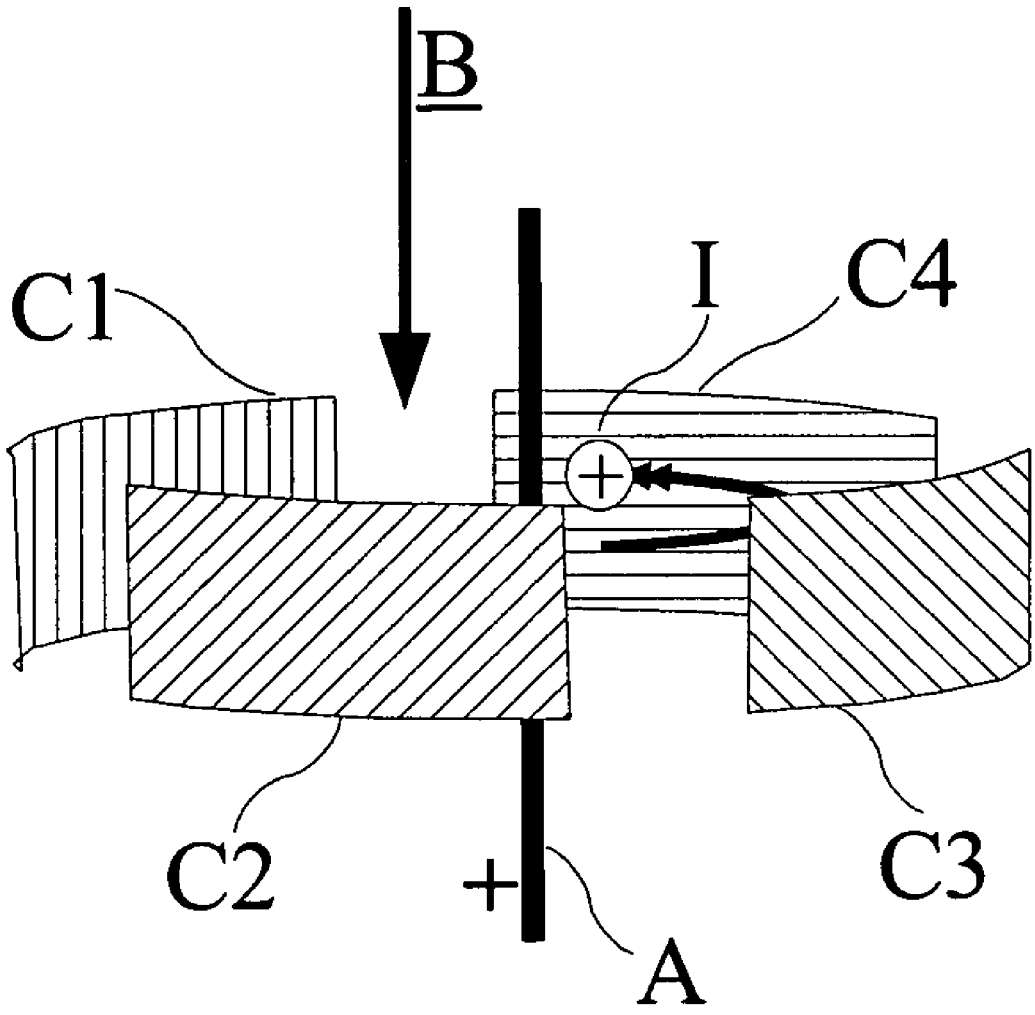
FIG. 3 is an alternative view of the electrodes, with respect to the magnetic field, of FIG. 1.
Figure 12:
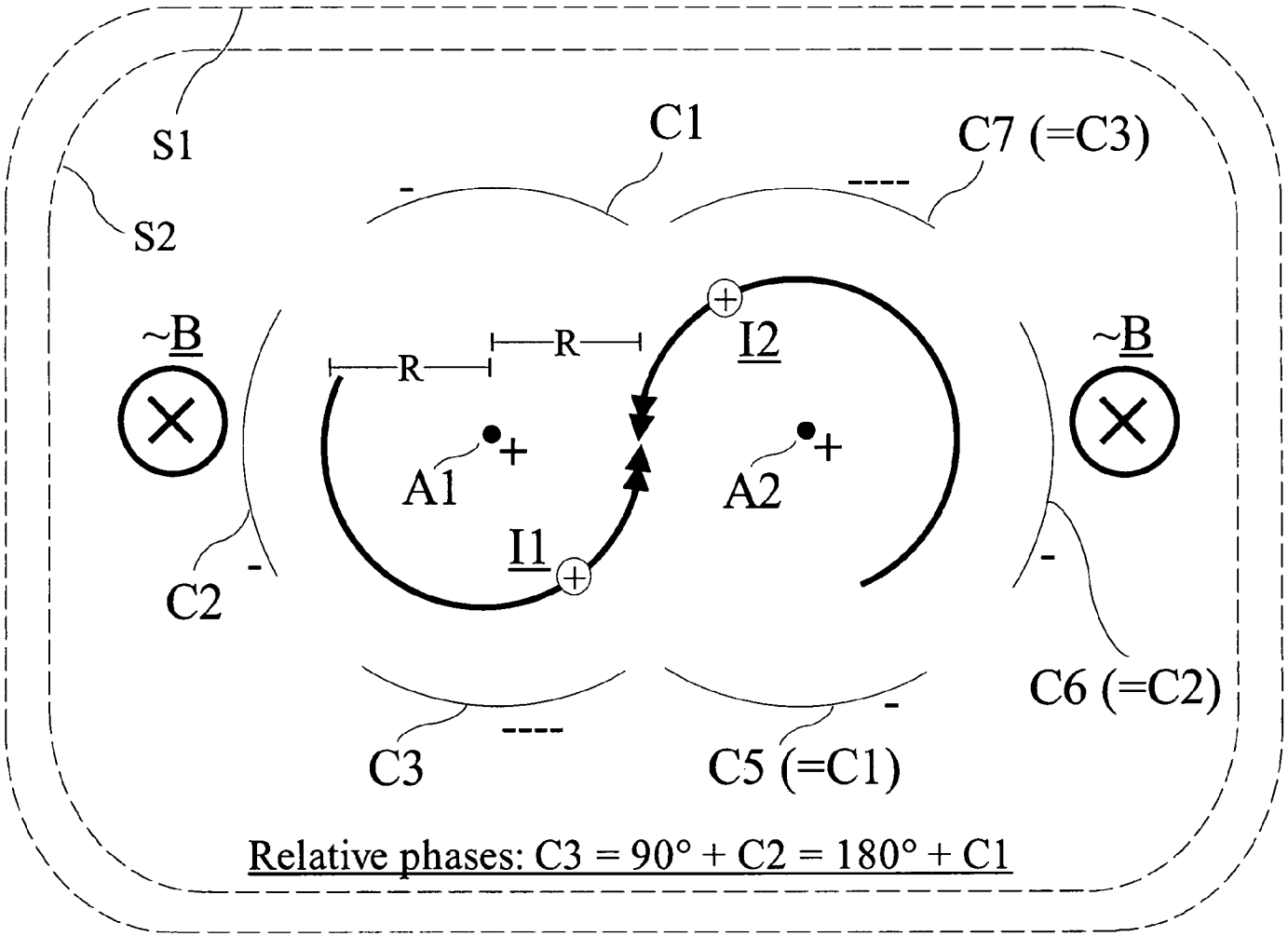

FIG. 12 shows two sets of electrodes, as per FIGS. 1 to 3, but with one outer electrode in each of two sets (otherwise 4 electrodes in each) removed. C5, C6 and C7 are additional outer electrodes of an essentially second set of electrodes, thus two ions, I1 and I2, can both be held in circular orbits about two central electrodes, A1 and A2, and can be brought into the same region of the device to promote a direct collision between the two ions.

Figure 13:
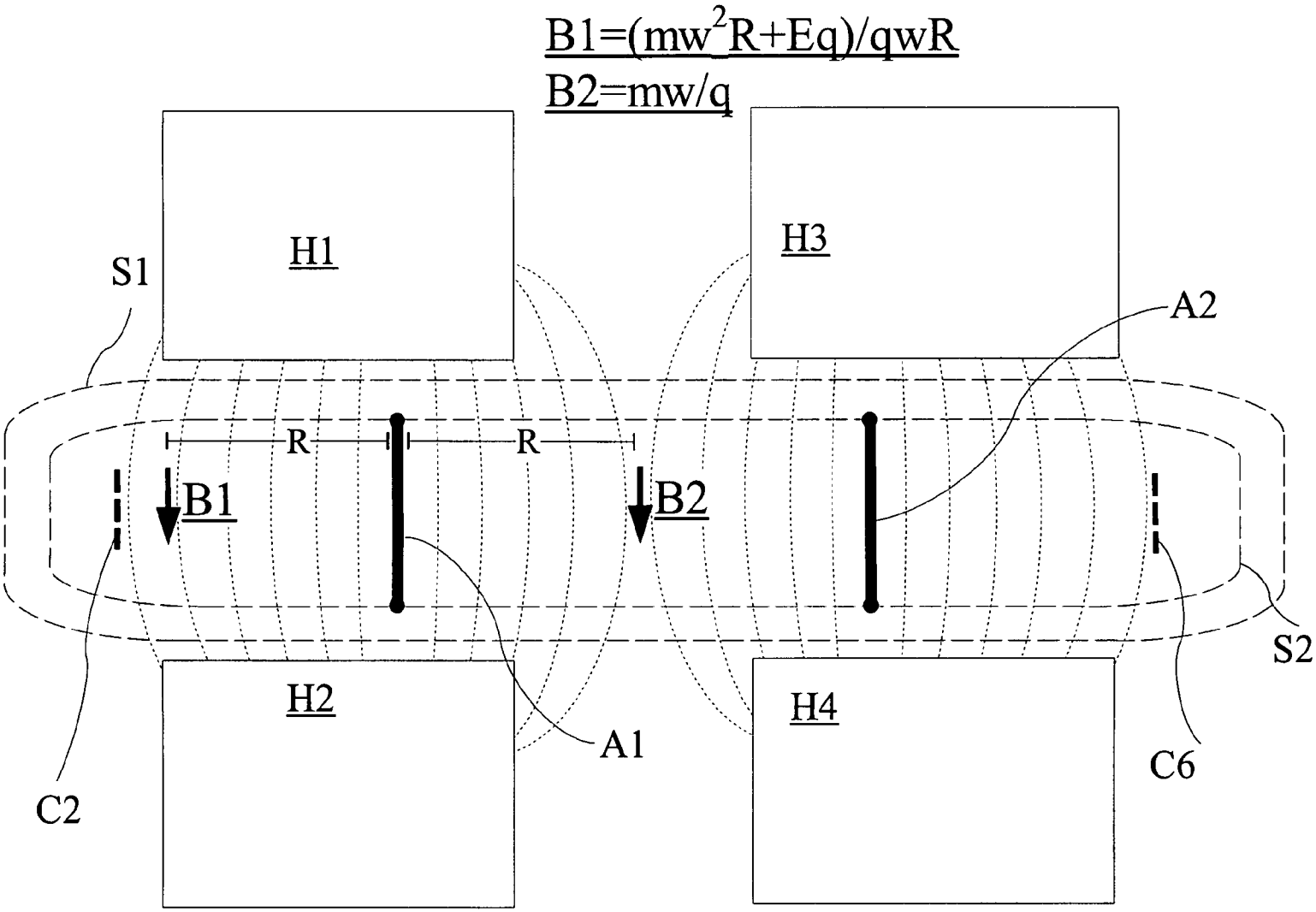

FIG. 13 shows an alternative view of FIG. 12, along with the 4 magnets, H1, H2, H3 and H4 providing the magnetic fields.

Figure 14:
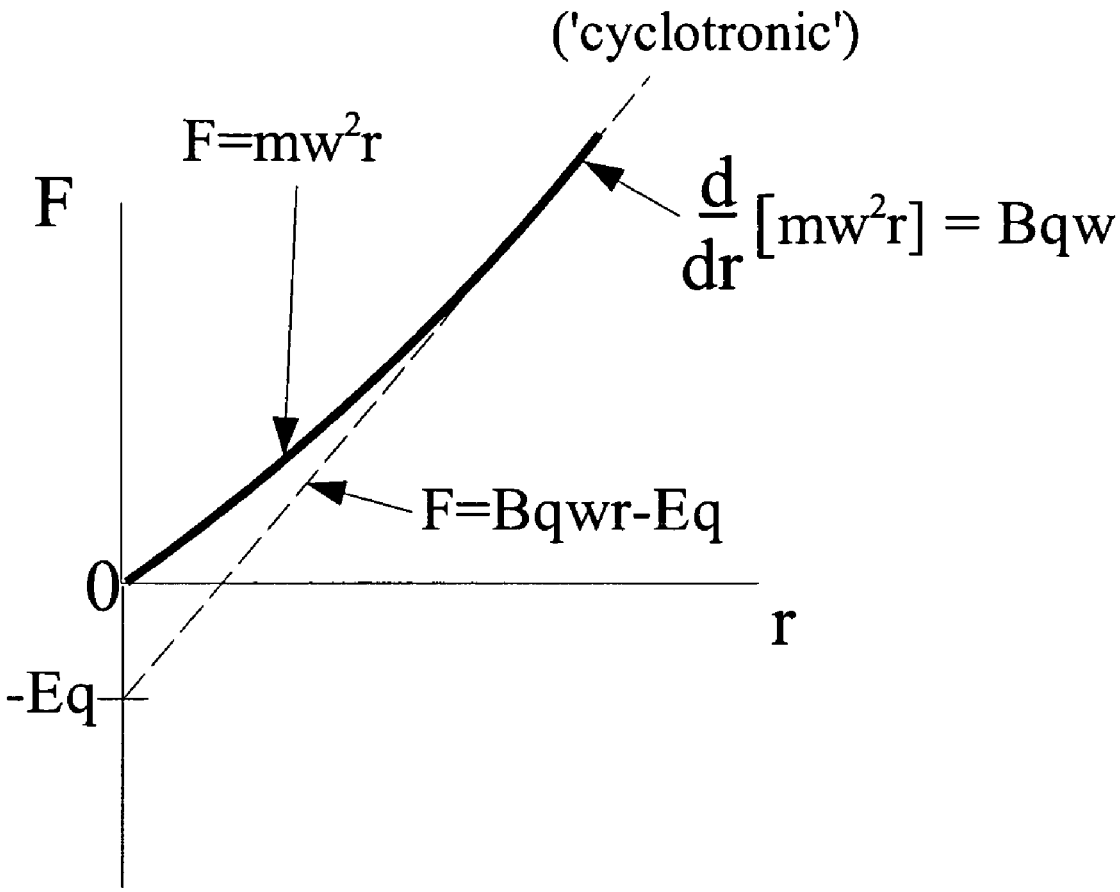

FIG. 14 is a further diagram of the balance of forces $F=Bqwr-Eq$ and $F=mw^2r$ which, for certain electric fields, can be used to compensate for the relativistic effects that a cyclotron cannot otherwise deal with.

Figure 15:
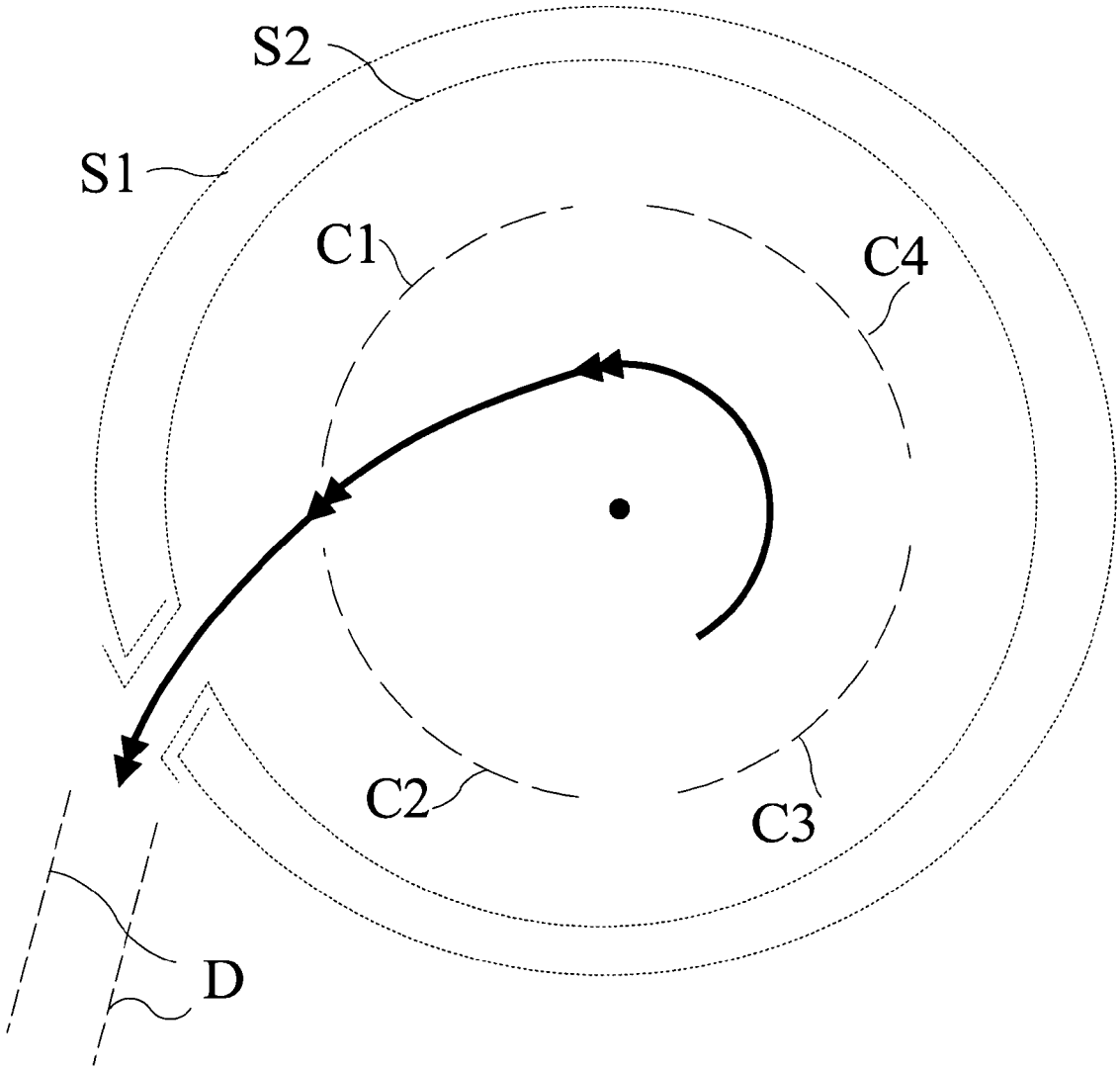

FIG. 15 shows how an ion path can be ejected from its stability orbit and through the outer screens to form a linear beam running through the tube, D.

Figure 16:
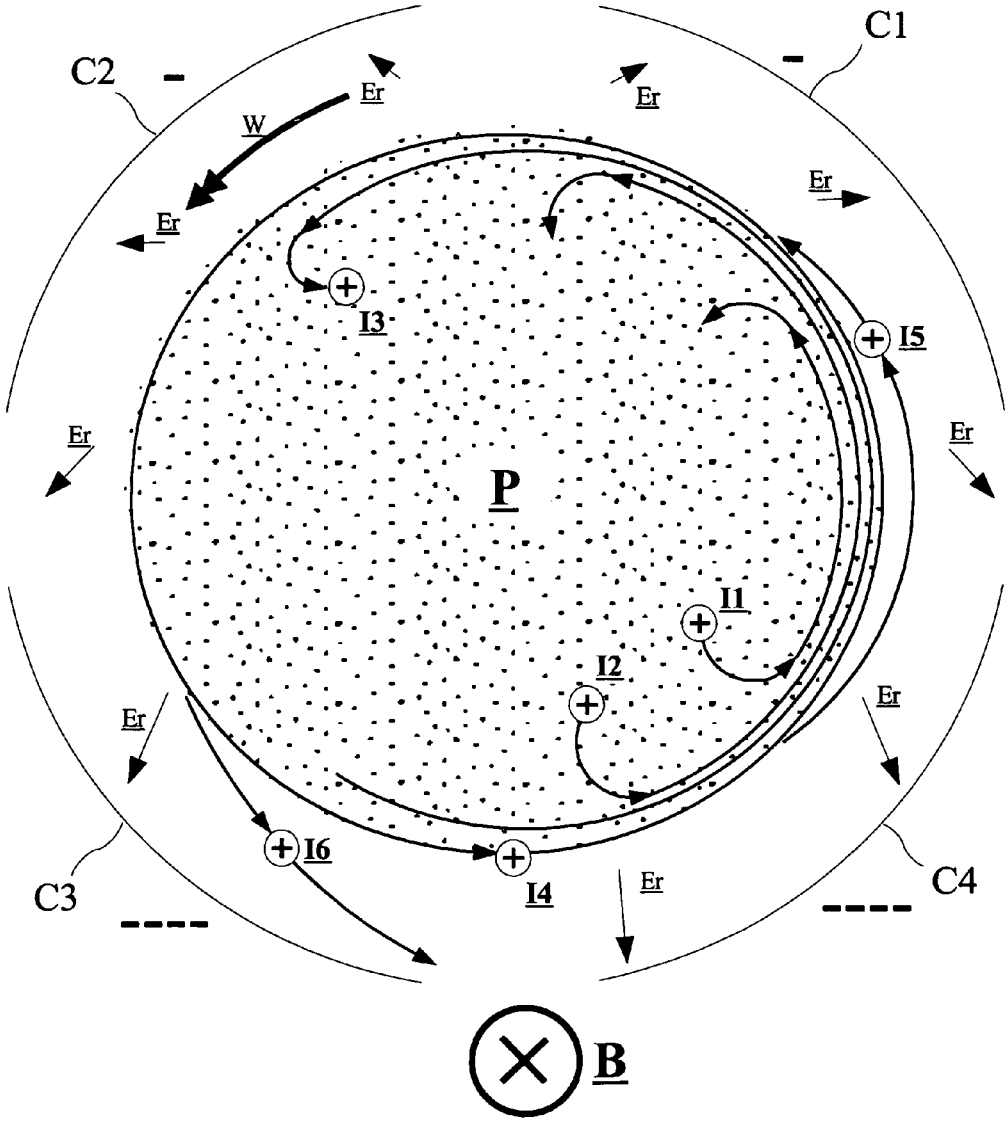

FIG. 16 depicts ion paths near the edge of a plasma-electrode embodiment. The potential of electrodes C1, C2, C3 and C4 are modulated with respect to the potential of the plasma, P, such that ions, I1 to I6, outside and near the edge of the plasma may experience a generally radial outward electric field force, Er (sample vectors of which are depicted by the length and direction of arrows). A pervasive magnetic field, B, passes through the plasma and generally orthogonally to the electric fields. Charging and discharging of the electrodes occurs sequentially in the direction indicated by the double-headed arrow, W, causing the electric field to rotate.

DETAILED DESCRIPTION

The present invention uses a non-axisymmetric rotating radial electric field, with peak magnitude E, generated between a central electrode and outer electrodes located circumferentially about the central electrode. FIG. 1(*i*) depicts a section view through a configuration embodying this invention with the general strength and direction of the electric field force, E, shown by arrows, and showing four outer, generally negatively charged, cathodes surrounding the positively charged anode.

Ions experience an electric field force away from the central electrode. The outer electrodes are synchronously charged and discharged in circumferential order. This sequential order is represented in FIG. 2, which is as FIG. 1 but displays the individual waveforms applied, and their relative phases, to the outer electrodes.

The electric field crosses an orthogonal magnetic field (B) such that $Bqwr=Eq+mw^2r$. This has a particular solution for r which defines the orbital radius that ions operating in this device tend towards (this particular solution is defined as R in subsequent equations). $Bq>mw$ is a condition demanded by this equation and shows that the magnetic field must be stronger than that otherwise in a conventional cyclotron. FIG. 1(ii) shows this balance of forces on an ion, I, whilst rotating about the anode, A, in the magnetic field, B. B is generally orthogonal to the plane of this view's section, FIG. 3 showing an oblique view of the orientation of the magnetic field with respect to the electrodes.

('q', throughout, refers only to the magnitude of the charge not its polarity and, thus, this equation of motion deals with the magnitudes of the forces for a charge moving in a direction resulting in a magnetic force acting towards the central electrode and an electric force acting away from the central electrode. The central electrode may therefore be any structure or structures, including plasma structures, formed on or around an axis and is herein described collectively as 'an electrode' where a net electric field force is generated generally radially away from that axis. The significance of the polarity of the charge is to determine the direction of rotation about, and the necessary polarity of, the central electrode to outer electrodes. For positive ions, which are principally discussed herein to describe the present invention, the central electrode is generally positively charged and the outer electrodes are generally negatively charged to provide the resultant net radial force.)

Figure 4:
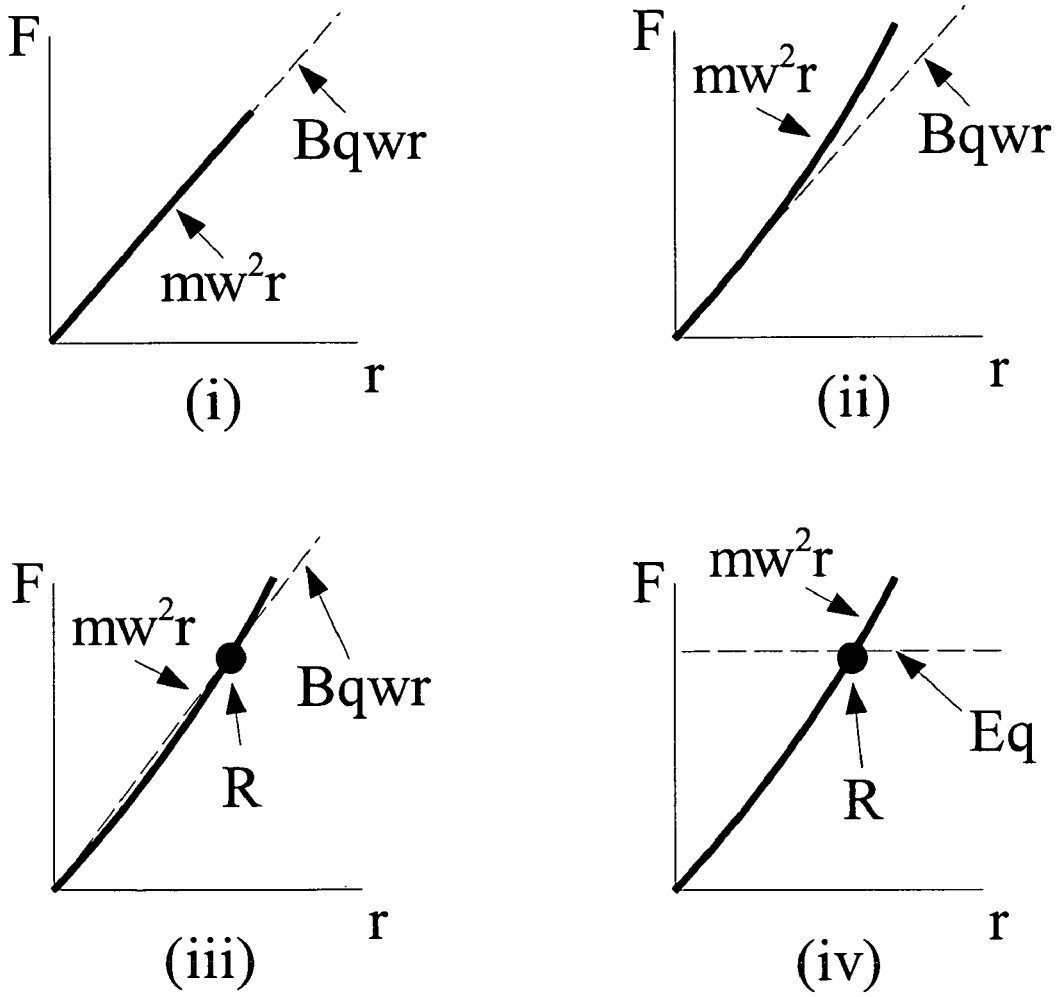
FIG. 4 are graphical descriptions of how the forces Bqwr, Eq and $mw^2r$ relate to each other in a cyclotron and how there are no unique radii where these forces balance except for R which is fundamentally unstable to small perturbations.

In the cyclotron, charged particles will spiral out without constraint of their radial extent as all radii are compatible with the cyclotron condition Bq=mw (providing this is true) as it is independent of radius. It therefore may appear counter-intuitive that the application of an outward radial electric field would help contain charged particles. This can be demonstrated graphically. FIG. 4(*i*) shows the equations of motion of a non-relativistic cyclotron at work. Here, the mass of the particle times its centripetal acceleration (the 'resultant centripetal force'), $F=mw^2r$, is equal to the magnetic field force, F=Bqwr, for all radii, and therefore will increase its radius as it increases its kinetic energy, providing angular velocity, mass and magnetic field remain constant. FIG. 4(ii) shows that when particles become relativistic, the resultant centripetal force is non-linear (as mass become a function of velocity) and becomes greater at larger radii (for a constant angular velocity) than the magnetic field can retain and so the system becomes unstable. If the magnetic field is increased to attempt to retain relativistic particles, FIG. 4(iii), then a solution for a given radius appears, R, but this is unstable because for any radii below this R the magnetic field is greater than the resultant centripetal acceleration demands, so the particle will spiral inwards, whereas for any radii greater than R the magnetic field is not sufficient to retain the particle's centripetal motion. Therefore, if a particle finds itself at R, any tiny perturbation will see it either running into the centre of the cyclotron, or spiraling outwards.

This critical instability is also why an electrostatic rotational containment, alone, cannot similarly work, in which a central electrode is attractive to the charged particle and such that its resultant centripetal motion is balanced within an electric field. FIG. 4(iv) shows such a case and, at R, forces arising from both centripetal motion and the electric field force it experiences are balanced. However the dashed line, depicting 'provided' force by the electric fields, crosses the solid line, depicting 'required force', from above that line to below that line with an increase of radius. This shows that any particles within radius R will have too great a net force towards the centre so will spiral inwards, and any above have too little net force retaining them towards the centre and will spiral outwards. Any actually at R are therefore unstable to small perturbations.

Figure 5:
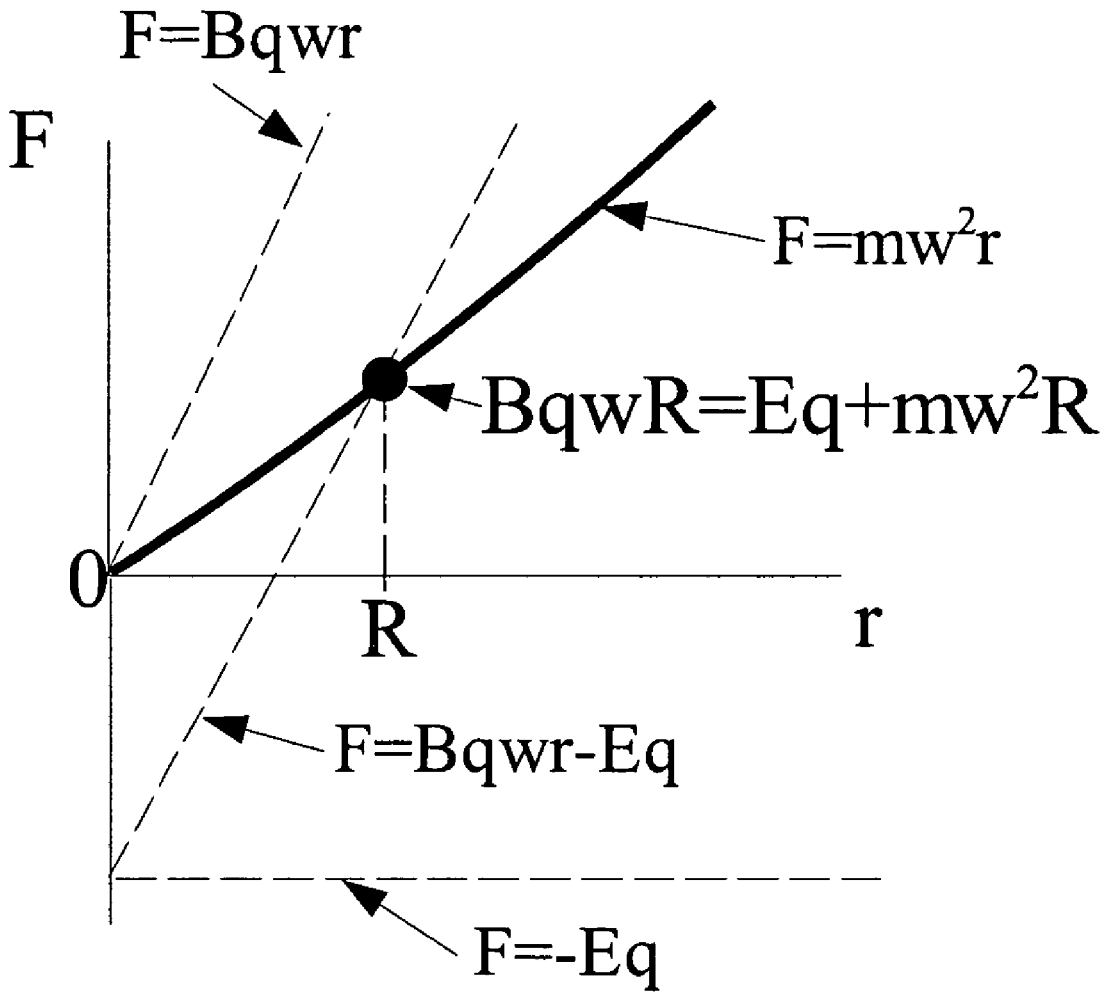
FIG. 5 is a graphical representation of how the same forces of FIG. 4 inter-relate in the present invention, which includes an outwardly directed electric force that opposes the magnetic force, and graphically shows how there is a natural stability radius, R, that the ions will tend towards.

There is only one configuration that permits permanent orbital stability for a defined radius and the present invention embodies this configuration. This is depicted in FIG. 5. Here, a magnetic field that is ordinarily greater than that required for a cyclotron must be used, and a radially outward electric field force, F=−Eq, subtracts from the resultant magnetic field force directed radially inwards, F=Bqwr. There is therefore a well-defined radius, R, which is the point at which the force provided, F=Bqwr−Eq, intersects the resultant centripetal force, $F=mw^2r$, at $BwqR=Eq+mw^2R$. This configuration is also immune to initial relativistic effects where m starts to become a function of wr (i.e. whether the $F=mw^2r$ plot is a straight or curved line does not impact the existence of a single solution, R) excepting when d/dr(mwr)>=Bq, this being the cyclotronic limiting condition.

Applying an electric force in opposition to a prevailing magnetic force is the only way that a dashed line (the provided force) in these diagrams can cross the solid line (the required force) from negative to positive with an increase in radius. This is the required condition for self-stabilising cyclotronic stability, which the present invention implements.

To accelerate and maintain ions within the radial field between electrodes, there is a synchronous switching of the electrode potentials such that the radial electric field within the device is not axi-symmetric and that the whole field rotates at a controlled frequency, w, (as per FIGS. 1 and 2, and where the waveforms W1, W2, W3 and W4 have a period of $2\pi/w$). Ions moving within, and synchronised with, the region of peak radial fields in the non-uniform electric field will, however, see only that peak field so long as they remain synchronous with it, thus must rotate at w. If they are perturbed from that rotational velocity which causes them to move out of that peak electric field they experience unbalanced net forces that take them on a new trajectory which brings them back into the peak electric field where more work is done on them, so accelerating them up to the velocity necessary for synchronisation.

For an ion, of charge q and mass m, rotating at w about the central electrode but as a radius displaced from the equilibrium radius R by ΔR (where r=R satisfies $Bwqr=Eq+mw^2r$) it can be evaluated that the correcting force in respect of R is defined by the scalar radial force=$-\Delta R[Bqw-mw^2]$. This practically says; if the radius increases without a velocity increase, so the magnetic force ramps up quicker than the centripetal acceleration of the ion and thus it falls back to the radius R, whereas if the radius decreases so the magnetic field ramps off faster than the centripetal acceleration of the ion thus it will spiral back out to R.

Similarly, if the velocity drops without an initial radius change then the magnetic field force will ramp down slower than the resultant centripetal force on the ion, so the magnetic field begins to dominate over the centripetal motion causing the ion to spiral in. As it does so its rotational frequency will increase (providing the electric field strength is within the conditions defined below) and it will then catch up with the electrode switching. As it catches up with the peak electric field it will again gain energy by radial acceleration in that field. This will continue until the ion gains enough energy to keep up with the rotation of the radial electric field.

A circular 'beam' of particles will result, though this beam will be composed, rather, of a somewhat diffused stream of particles (dependent on the total current, and thus the local space-charge, in that stream) that would tend to clump into azimuthal angles around the peak electric field.

For this mechanism to occur the minimum radius whilst out of the peak field must not generally be less than R/2 otherwise the ion may find itself performing a complete gyro-rotation without passing around the central electrode. It is possible for this mechanism to still function but instabilities may result. This condition, for minimum trajectory radius less than R/2, is not an onerous condition to satisfy and is consequential to other conditions described later.

In the special case that the ion begins to take on too much energy its velocity will mean that the resultant centripetal force begins to dominate and it will take up a larger radius. It will take up a slower rotational frequency in its larger radius but it is possible that it can get ahead of the peak electric field and will begin to run away because it will gain yet more energy as it catches up with the peak electric field again. This would occur, for example, where the electric field is too strong for stability in the device. This run-away ion will only be slowed if it undergoes ionisation or scattering events with the background medium or, even, with the fast ions in the orbital beam, for it may eventually take on orbital patterns not centred about the central electrode due to the relatively diminishing magnitude of the electric field in comparison with the magnetic and centripetal components. Excepting for this condition of the ion in run-away, the ions in the beam will remain coherent both in phase (relative azimuthal angle) and in velocity and will recover to this state after small azimuthal or radial perturbations.

An additional contribution to maintaining the ion at the rotational velocity is a circumferential component of electric field generated due to the differential charges on the outer electrode. As can be seen in FIG. 1(*i*), if the ion is lagging behind the peak field then the circumferential components will tend to accelerate its rotational speed, whereas if it is getting ahead of the peak field then it will be decelerated.

If a particle is radially accelerated to the orbital radius R and arrives there with more energy, i.e. with an excess speed, than is needed to maintain that R at the prevailing rotational speed, w, then it may immediately enter the 'run-away' condition. Therefore there is a maximal electric field that must be observed to prevent this and to minimise the amount of work that can be done on an ion. An ion formed as a stationary particle at the centre of the device and which accelerates along the peak radial field will reach the stability orbit of radius R with energy EqR. This must not exceed $(mw^2R^2)/2$, this being the kinetic energy of an ion already stable in the circular beam. Thus $w^2>2Eq/mR$. There is therefore a minimum rotational velocity for the system, as defined by this criterion, below which instabilities may occur. A physical interpretation is that if the electric field is too strong, then an ion undergoing a positive radial displacement will have work done on it by the electric field that then causes a velocity increase which may lead to its centripetal acceleration exceeding that which can be contained by the increased magnetic field component.

This condition for electric field strength is also the same condition defining whether a slowing ion will loose too much energy as its radius diminishes. For the process of ion recycling to work as described, an ion must increase its angular velocity with a decrease of radius, and must decrease its angular velocity with an increase of radius, both of which are true providing $w^2>2Eq/mR$.

$w=\sqrt{(2Eq/mR)}$ should therefore be considered a 'primary system frequency' (denoted W hereafter). Operation of the device, w, should be set above this frequency for stable behaviour, but not excessively above W because a slow ion may see only the time-averaged resultant of the fields if the device is operating too fast. The operational frequency, w, of the device should be such that the time it takes for an ion to accelerate in the electric field out to radius R is within the same time the electric field actually takes to rotate back to the same position. If an ion were travelling radially at the same speed as the circular beam ions then this factor would be simply $2\pi$, but as an ion might actually be stationary as it begins its trajectory, its time to reach R would be doubled relative to the beam velocity (this being the average over a period of linear acceleration). Thus, the operational frequency of the device, w, should be set with respect to the primary system frequency, W, such that $W<w<\pi W$. This is not an essential condition and a device may still function outside this criterion, but with potential instabilities.

By way of examples, FIG. 6 presents some idealised views of the paths that ions may take. FIG. 6(*i*) shows a positive ion formed near to the central anode, A, that is initially accelerated towards the cathode C4. As it get to the point 'a', cathode C4 discharges and so the ion now experiences no balancing force counter to the magnetic field so takes up a tighter radius. It is accelerated circumferentially by a small degree by the field between C4 and C1 and also continues on it tighter radius. It catches up with the peak field (now at C1), is accelerated radially out towards C1, and in doing so gains enough energy to maintain a stable orbital condition in synchrony with the rotating electric field.

FIG. 6(ii) depicts an ion formed mid-way between the central electrode and the orbital stability radius, R. It accelerates towards the peak field at C4 (not labelled, but elements as per (i) throughout FIG. 6), but C4 discharges so at 'a' the ion takes on a tighter radius. It orbits close to the central electrode and picks up the peak electric field again at 'b' and then enters synchrony with the rotating electric field.

FIG. 6(iii) depicts an ion stable in the circular beam being scattered by an event at 'a'. It passes the C4 electrode. The ion then takes on a tighter radius as the net forces towards the centre include the attraction to C4 (i.e. Eq sums with Bqwr rather than counters it) until 'c', where it crosses back through C4. C4 discharges and the ion orbits around until it catches up with the peak electric field again at 'd' where work is done on the ion which brings it back into the stability orbit.

FIG. 6(iv) depicts a beam ion scattered at 'a' but as it passes through C4 to 'b', C4 discharges. However, the ion has already taken up the full kinetic energy that the electric field from C4 can apply so follows a trajectory away from the outer electrodes and passes an inner screen, S2. S1 is a nested screen completely enclosing S2 (which in turn completely encloses the inner and outer electrodes, both of which are generally permeable to the motion of ions) and is charged to a high positive potential such that the ion's trajectory in the electric field between S1 and S2 reverses the direction of its radial path at 'c'. Passing back through S2, it performs a full gyro-orbit whilst out of the peak field and passes back through C11 at position 'e'. It then matches up with the peak electric field and is brought back into synchronisation.

The common feature to any such ion paths is a correcting force, $\Delta R[Bqw-mw^2]$, which accelerates an ion back towards the stability radius, R, and is a scalar radial force. The equation of motion radially for an ion is therefore $\Delta R[Bqw-mw^2]=-m\cdot\{d^2\Delta R/dR^2\}$. This is the condition for simple harmonic motion about R with a period$=[2\pi/w]\cdot[1/(\sqrt{\{(Bq/wm)-1\}})]$. The factor $2\pi/w$ is the period of orbit for free beam ions, so the remainder is a factor relating the number of radial oscillations about the stability radius R to the actual orbital period. That is, $\sqrt{\{(Bq/mw)-1\}}$ is the number of times an ion will oscillate around the stability orbit, radius R, for each axial rotation about the central electrode.

Further, as an ensemble of particles all attempt to perform the same oscillation, the only stable resolution to their group behaviour is that they spiral around the stability orbit rather than oscillating strictly in the plane of rotation, otherwise they would interfere with each other's paths. They will therefore orbit close to, but not necessarily on nor cross, the stability orbital condition of constant R, and will adopt trajectories that follow the surface of a torus nested about the stability orbit. The ions' behaviour is therefore a facsimile of ions within a tokamak, though the fundamental driving forces are quite different. The factor $\sqrt{\{(Bq/mw)-1\}}$, which dictates poloidal rotations to toroidal rotations, is directly equivalent to the so called 'safety factor' of tokamaks. The same consequences of stability apply, namely the higher the safety factor, the more stable is the system.

This toroidal motion provides some axial stability, but is not entirely adequate for axial focussing. In general, the ion beam may drift axially in a uniform magnetic field. There are a number of solutions that may be applied to resolve this:

Axial stability solution 1: Outer electrostatic screens have been described whose purpose is to capture and recirculate any ions that would otherwise escape the system following scattering. These electrostatic screens can be extended to fully enclose the outer and inner electrodes, forming a recirculation system for all ions scattered in any 3 dimensional direction. To gain axial stability, the central electrode can be electrically connected to the inner screen. A positive ion at any location within the inner screen will then be accelerated towards the most negatively charged outer electrode by an electric field force which may also have an axial component of acceleration if the ion is not in the plane of the beam stability orbit. This therefore provides axial stability that brings an ion back into the plane of the beam. FIG. 7 depicts such a configuration, with ion I1 rotating at angular velocity w and remaining in balance with the peak electric field between the positively charged central electrode, A, and the negatively charged electrode, C3. Ion I2, however, is not in balance being off the central plane of orbital rotation and it is experiencing an electric field force directed towards C3 which includes a vertical component (the electric field force on the ion being indicated by the arrowed lines). It is therefore experiencing a corrective axial force arising because the central electrode, A, and the screen, S2, are at a common potential.

Axial stability solution 2: A magnetic focusing may be applied such that the curvature of the magnetic flux lines tends any ion motion back towards the centre line. This takes advantage of fringing effects at the edges of magnetic faces and relies on the local compression of flux towards a magnetic face. Ions will tend away from this flux compression by the so-called 'grad-B drift' motion. This is well known and is used in the cyclotron and in some magnetron designs. The magnetic field, however, reduces as radial distance increases in this configuration (and if it drops to or below the magnetic field level otherwise required for simple cyclotronic motion, viz. $Bq<=mw$, then the system will become unstable). This affects the general system description, $Bwqr=Eq+mw^2r$. However, electric fields tend to be strongest about physically smaller electrodes, this being the cause of coronal effects in which localised electrical breakdown occurs about small electrodes. So the electric field also tends to diminish away from the central electrode. These two effects (radial diminution of both the electric and magnetic fields) must be set to balance adequately by the design and analysis of a device. Other so-called 'magnetic weak-focusing' techniques and geometric alterations of the magnet faces are known in the field of cyclotron engineering and these solutions equally apply to the present invention. FIG. 7 also shows this axial solution with two magnets, H1 and H2, that impose a generally axial field but that also has fringing at the face and flux compression. Thus, the ion I2 not only experiences the electric field corrective force, of the 'stability solution 1', but will also be experiencing a magnetic force with a component that also tends it back to the central orbital plane.

Axial stability solution 3: The axial dimensions of the device can be extended (extruded), permitting the beam ions to spread out axially and, as they come close enough to be influenced by the fields of the inner screen (held to the potential of the central electrode as per solution 1), they will be held in an extended cylinder of ions still moving with a radius of, generally, R dimension about the central electrode. The magnetic field can then be generated by a solenoid rather than permanent magnets. Extending this principle, a third solution to axial stability is therefore to extend the device indefinitely in the axial direction but to curve it around and bring it back on itself to form a torus. Thus, no axial constraints at all are imposed and the whole device is 'extruded' into a toroidal shape such that the central positive electrode instead becomes a ring, the outer screens become nested toruses and the outer electrodes become continuous spiral elements wrapped as if on a toroidal surface, and back onto themselves. The ions will no longer take up a 'beam' motion but their motions will be generally diffused around the toroidal structure. Instead of following a given circular orbit, they will be free to follow any path on a toroidal surface of minor radius R; that is, providing they poloidially orbit the central conductor with the same radius of circular orbit were it otherwise constrained axially. The magnetic field can then be generated by a toroidal solenoid. FIG. 8 shows a sectioned view of such a device, with the nomenclature of electrode structures as per the other figures.

The equations of free-particle motion derived from $Bwqr=Eq+mw^2r$ describe a system very similar to a cyclotron and that can function in the same way but without sensitivity to the $Bq=mw$ condition required for cyclotrons and with immunity to small relativistic effects. However, to then consider this as a fusion energy device, this must be a collisional system and such collisions may occur during the ion beam motion through the background medium. To achieve a goal of direct fusion net energy gain from interaction of beam nucleii with the nucleii of the background medium the total losses of these collisions must be less than the total energy gain.

Net fusion energy from beam interactions is generally discounted because the ratio of cross-section of fusion, $\sigma(f)$, with the cross-section of scattering, $\sigma(s)$ (which then defines the probability of a fusion event compared with other atomic interactions) is very low. This is denoted $\sigma(f)<<\sigma(s)$. However, this is not an exclusive bar to beam fusion providing $\sigma(f)/\sigma(s)>Q(in)/Q(out)$, where Q(in) is the beam ion collision energy with the target nucleus and Q(out) is the energy out of the reaction following a fusion event. However, this is still impossible to meet with any known fusion reactions.

The present invention may overcome the $\sigma(f)/\sigma(s)>Q(in)/Q(out)$ condition by preserving the energy of the ion after non-fusing collisions. Ordinarily, a beam ion would loose its energy over many collisions, almost none of which are, probabilistically speaking, likely to end in a nuclear fusion event. An ion that looses a small fraction of its energy whilst in the beam of the present invention will be accelerated back up to beam energy by the processes already described. Very large nuclear scattering angles may send the ion beyond the outer electrodes, but then the secondary system of electrostatic screens recovers this ion. Therefore, instead of the loss of an ion at energy Q(in), the device only needs to input the average scattering energy loss in each collision event instead of having to re-generate that ion with the consequent consumption of another Q (in)-worth of energy for another ion. Thus, if a particular relative scattering energy loss for a collision, k[n], is averaged over n=0 to N collisions and the average is denoted k(av) then the condition for net energy gain becomes $\sigma(f)/\sigma(s)>k(av)/Q(out)-Q(in)$ (the denominator of the RHS being the net energy output, comprised of subtraction of the initial energy input into the ion from the output energy).

The average energy loss due to nuclear Coulomb scattering, kc(av) can be shown to be $kc(av)=s^2\cdot\ln\{d^2+s^2/s^2\}/d^2$ where $s=[z1\cdot z2\cdot k\cdot e^2]/[2\cdot M^2\cdot Q(in)]$, for k=Coulomb constant and e=elemental charge, and where d is the maximum impact parameter up to which kc(av) is calculated and where M is a correction factor to the usual treatment of Coulombic collision for which the target particle is ordinarily considered stationary so that M=(m1+m2)/m2 where m1 is the mass of the projectile (i.e. beam) nucleus and m2 is the mass of the target (i.e. background) nucleus. The condition for net fusion energy gain in overcoming the Coulomb scattering losses can then be determined as $\sigma(f)>[\pi\cdot Q(in)\cdot s^2\cdot\ln\{d^2+s^2/s^2\}]/[Q(out)-Q(in)]$, but electron scattering losses are additional to this.

This condition has solutions for some fusion reactions, though only at very high energies. A deuteron ion beam passing through a deuterium gas may be considered to either ionise a background neutral, take the electron of a background neutral, scatter with the nucleus of a background atom, or fuse. At the highest ion energies for thermal deuterium in tokamak magnetic confinement machines, this being of the order of 20 keV, the cross section for these ionisation and electron-sharing events is some 10 GigaBarn and, when compared with the fusion cross-section of deuterium-deuterium (DD) fusion of 0.3 millibarn (these being experimental data), means that ionisation is $3\times10^{13}$ times more likely than a fusion event. The fusion energy out (averaged between the reaction outcomes) would be 3.7 MeV whereas the energy in for ionisation events alone would be 13.6 $eV\times3\times10^{13}$=400,000 GeV. This is entirely impractical at the temperatures of a thermal fusion plasma and for the deuterium-tritium reaction, whose fusion cross-section peaks at yet lower energies than DD, this beam process cannot work.

However, at 500 keV, the effective cross-section for charge exchange and ionisation events for deuterons comes down to around 5,000 barn whilst the DD fusion cross-section approaches 0.1 barn. Therefore, there would be 100,000×13.6 eV worth of ionisation and electron sharing collisions expected, amounting to 1.36 MeV. Also, there would be Coulombic nuclear scattering events that may be approximated as those within 3,000 barn (which is a <10 millirad scattering angle) and the average scattering losses within this cross section is kc(av)=17 eV per collision amounting to 17 eV×30,000=500 keV. Therefore, after 130,000 collisions per ion at 500 keV, around, and only, 1 of those collisions is expected to be a fusion event. The energy consumed by the present invention for these 130,000 collisions (and one fusion event) is predicted to be 2.1 MeV, this being the sum of collisional losses that the device feeds back into the scattered ions. Given the initial input energy per particle of 1 MeV, this would amount to an input energy of 3.1 MeV with a fusion energy output of 3.7 MeV, thus demonstrating theoretical net fusion energy gain.

(Cyclotron radiation losses from rotating nucelii at these angular velocities is several orders of magnitude lower than the losses due to ionisation, and can therefore be practically ignored. This is not so true of the free electrons, however, that will radiate cyclotronic electromagnetic energy and cool down, which in turn would increase the probability of recombination with ions. However, it is likely that such electrons will tend towards the region external to the outer electrodes to perform their ExB drift motions, in the fields between the inner screen and electrodes, and this recombination probability with beam ions is therefore reduced.)

Sample dimensions of an embodiment of the invention can be calculated, with due approximation, to achieve the desired beam energy of 1 MeV from the above calculation (this being necessary to achieve the collision energy of 500 keV due to reduced mass between the beam ion and the stationary target nucleus): The velocity of a 1 MeV deuteron is ~10 Mm/s. Assume a device operational speed of 5 MHz is practical, then the circumference of the orbit must be 2 m, giving a radius=0.32 m. Thus, $mw^2r=1\times10^{-12}N$. Let $Eq=5\times10^{-13}N$ and $Bwqr=1.5\times10^{-12}N$ to balance the principal equation of motion, giving B=0.93T and E=3.1 MV/m. The condition $W=\sqrt{2}Eq/mR=4.97$ MHz, so $W<w<\pi W$ is satisfied. Suitable outer electrodes may therefore be separated by 0.5 m from the central electrode, requiring a negative voltage potential maximum of ~1.5MV.

(The maximum stability for the scalar correction force, $\Delta[Bqw-mw^2]$, can be shown to be when $Bqwr=2\,mw^2r=2Eq$. However this results in solutions in which $W=w\cdot\sqrt{2}$ that then conflicts with the $W<w<\pi W$ condition and also demands higher magnetic and electric fields that pose more arduous practical requirements. A device embodying the invention can be operated up to this maximum stability condition, $W=w\cdot\sqrt{2}$, but it becomes critically unstable if the electric field is at all perturbed and radial work on the ions is momentarily higher than designed for as may occur from transient behaviour.)

(The condition $W<w<\pi W$ may be re-written as $(1/2)\,mw^2R>Eq>(1/2\pi)\,mw^2R$. For the W<w condition; balancing the magnetic field force, BqwR, is done by an electric field force no bigger than one half of the resultant centripetal force, which is therefore one third of the magnetic field force. This results in a 'safety factor' of $1/\sqrt{2}$, or ~0.7. This is as per the example above where a $Bqwr=3Eq=(3/2)mw^2r$ condition has been employed. Whereas at the $w<\pi W$ end of the condition, the electric field force is only ~one sixth $(1/2\pi)$ of the resultant centripetal acceleration giving a 'safety factor' of ~0.4. So although using an electric field of just one sixth of the centripetal force also reduces the demands of the magnetic field strength, it also reduces the stability of the device.)

The 1.5 MV electrode charge does not need to be fully switched at 5 MHz. Apart from the practical difficulties, this would introduce undesirable transients in the system due to very large dV/dt that would disrupt the electric and magnetic fields in potentially unpredictable ways. Instead, it is only necessary to discharge the electrodes sufficiently to accelerate an ion back towards the next electrode if deflected. A Coulomb scatter of an ion through an angle a=1rad would be a very close pass to a nucleus (this would be a scattering cross-section of ~0.2 barn, cf the fusion cross-section of ~0.1 barn, such that there would only be two such high angle scatters versus one fusion event) and it would loose kinetic energy according to $\sin^2(a/2)$ which is a loss of 25% of the ion's energy amounting to 250 keV. Discharging the electrodes by 250 kV, rather than discharging the whole 1.5 MV, should therefore be more than adequate as this energy would then be recovered in the transit from the vicinity of one electrode to the other alone, notwithstanding the radial component of work on the ion. Therefore, the electrodes could switch between −1.5 MV and −1.25 MV relative to the central electrode for high stability, though it may be expected that in practice the differential switching range can be even less than this to achieve circular beams But it is not clear how small the differential switching can get before scattering losses would make net-energy gain fusion non-viable. This is likely to be determined by experimentation as it may be affected by many various aspects of the design of the device.

The shape of the charging waveform on the electrodes is ideally a pure square wave to ensure uniformity of the radial fields that the circling ions experience. However, an RF sinusoid is the more practical implementation at these elevated voltages. Whether an RF sinusoid or a square wave, there will be a natural compression and distortion in the waveform anyway as a consequence of the actual loading that the device would place on a real power supply. Therefore, precise regulation, and a precise definition, of waveform shapes to use in a device designed to the principles of the present invention is unlikely to be a guarantee of successful energy coupling into the device and the waveform used will have to be selected and engineered so as to accomplish the task and will therefore be one likely proved experimentally. Consequently, the beam's orbital shape may be more diffused than theoretically ideal were an accurate square wave applied, as the ions will struggle to occupy the same azimuthal position of peak electric field if there is an increased space-charge concentration arising from the limited circumferential extent of consequentially distorted and/or compressed electric field peaks.

A device embodying the invention need not have particularly 4 outer electrodes. Any number is possible for implementation of the principal, but generally it should be 3 electrodes or more so as to ensure there is a well-defined direction of rotation. Two electrodes, or even one, may be made to work along the same principles but charged particles may tend to undergo various non-orbital oscillatory motion that would be detrimental to the device. 4 electrodes works well for a variety of practical reasons and so is generally discussed to describe the principle of the present invention. In larger devices such as the 1 MeV beam device, dimensioned herein, there is more physical space to install higher numbers of electrodes and one benefit is to drive two peak fields within the device. That is, each electrode is charged to the peak potential twice in each rotation. The reason is that at very high beam currents, which would be necessary for net fusion energy gain, the electric field forces will become comparable with what the electrode can mechanically bear. Having electric fields diametrically equal will alleviate unbalanced electric field forces on the central electrode. This necessitates that the electrodes are driven at twice the frequency of rotation, and that electrodes on opposing sides are equally charged at any one time (and may be electrically connected to enable this). This configuration could theoretically be implemented by 4 electrodes, though 8 electrodes would be an improvement so that the electrodes can be cycles in pairs. Similarly, more than two peak fields can be generated within the whole rotating electric field pattern.

Cycling the outer electrodes in pairs provides practical advantages, that is at any one time two adjacent electrodes are charged. This is not a necessary requirement providing the electric field rotates around the central electrode at the constant angular velocity, w, and the peak field is generally steady in magnitude, but, in the case of a 4-outer-electrode construction, by switching in pairs the waveforms are more regular 50% duty cycles which provides various practical benefits. Also a more consistent field for the ion beam is generated by cycling pairs of electrodes. For 4 outer electrodes C1, C2, C3 and C4 in that order around the central electrode; at time step 1 both C1 and C2 are maximally charged, C3 and C4 are discharged; at time step 2, C2 and C3 are maximally charged, C4 and C1 are discharged; at time step 3, C3 and C4 are maximally charged, C1 and C2 are discharged, and in the final step of the repeating cycle, C4 and C1 are maximally charged and C2 and C3 are discharged. This switching arrangement ensures there is a steady electric field for ions passing through the azimuthal angles between outer electrodes and they experience a minimal discontinuity in the electric field that they are travelling with. (For positive ions, charging on the outer electrodes is the maximum negative potential with respect to the central electrode, and discharging may be only partial discharging where a full discharge is not essential for operation of the device).

This switching arrangement may be accomplished by various means well known in the field of control electronics. One example is to use two adjacent channels of a binary counter, driven by a control frequency at 4 w, such that as they count '00', '01', '10', '11', then repeat, so electrode C1 is connected to the first bit of this counter output and C3 is connected to the inverse of this first bit (i.e. through a NOT gate) whilst C4 is connected to the output of an XOR gate of the two bits and C2 is the inverse of the XOR gate output. This provides the necessary phase separation for the electrode timing. However, to achieve very high speed switching with only commercial grade components is not trivial in this way because a typical binary counter will momentarily count '11' in between '01' and '10' whilst the registers updates, similarly '01' appears between '11' and '00'. This produces a switch-on spike that may transfer through to the switching circuit (for electrodes C2 and C4, in this example). A quad-state circuit is therefore disclosed with the present invention consisting of 8 interconnected NOR gates which provides the necessary output for all four electrodes simultaneously and is a circuit which can only adopt one of four states at any one time. The circuit is shown in FIG. 9. The circuit cycles to the next of four states on each leading and trailing timing edge of the input signal, which means that any oscillating signal, including a sinusoid, is adequate to drive the circuit providing its input average level is generally matched to the mid-point of the input logic levels for the NOR gates (which may be by a resistor divider network, or other solutions well-known in electronics) and in this way provides sufficiently accurate 50% duty cycling outputs for use with the present invention. This circuit may have further applications in other fields requiring this type of quadrature timing method.

The outputs from this circuit, L1, L2, L3 and L4, or from any other timing circuit that accomplishes the same task, may then be fed into a circuit similar to that of FIG. 10. Such circuits are well-known, and which may involve necessary electrical isolation between the switching circuits and the gate controls to the MOSFETs driving the electrode outputs, and many well-known variations to this basic layout would also be suitable for use with the present invention. FIG. 10 shows how the switching circuit outputs may be tied to a low negative potential such that an electrode to which it is attached would be held down to the lowest potential (voltage=−DC 1) but then discharged to another negative potential (voltage=DC2−DC1) which is not necessarily fully discharged with respect to the central electrode (voltage=0).

The circuit of FIG. 10 requires that the electrode driving circuits are directly connected to the minimum electrode potential, −DC1. However, for safety and practicality an alternative is to use charge circuits which allows the electrode drive circuits to be isolated from direct electrical connection to the lower potentials such that they may be held closer to the ground potential. An example of such a circuit is shown in FIG. 11. Such circuits are well-know in the field of electronics. In the application to the present invention, this permits the generator circuits of W1, W2, W3 and W4 to be tied to the 0V potential of the system, yet the outer electrodes of the device, C1, C2, C3 and C4, will then alternate between −DC1 below 0V and −DC1-DC2 below 0V.

In the embodiments shown and the devices described in the figures, the central electrode, A, is held at nominally '0V'. As the inner screen, S2, is electrically connected to A, so S2 is also at '0V'. To return positive ions to the electric fields between the switching electrodes, the outer screen, S1, must therefore be held at a relatively positive potential to S2. The maximum likely kinetic energy of ions in the device should therefore be established and S1 and S2 held to suitable voltages to generate an electric field between S1 and S2 capable of decelerating such ions before they reach S1. It is not generally important whether the inner screen or the outer screen is actually held at a ground potential relative to electrical potentials external to the device. However, it may be appropriate to earth the outer screen if there is a chance that ions may exist outside the outer screen, S1, because if this were so then it may cause the acceleration of such ions towards any grounded structures. The disadvantage of doing so is that the power supplies and switching circuits must then be held to what would then be the potential of S2, which would be negative with respect to ground. In any case, either S1 or S2 should be held to a stable potential relative to ground to provide EMC (electromagnetic compatibility) protection against radio-frequency interference (RFI) escaping the device and interfering with surrounding equipment. Such RFI may be very significant, particularly if very sharp-edged square waveforms are used, and is of no minor significance. In the simplest case this would be a direct connection of S1 or S2 to ground, but also suitable capacitive coupling would be satisfactory (as is well-known in the field of EMC) and this has the advantage of safety for individuals coming into accidental contact with parts of the device, as they will not be completing a DC circuit through to ground. Further, electron cyclotron radiation may occur, quite likely in the microwave bands, which may create a non-ionising radiation hazard of its own which the screens would need to block. Thus the outer screen, S1, may need to be of a fine mesh, or possibly of solid construction, to mitigate microwave energies.

There is no necessity to construct the outer-most screen, S1, in a way that makes it permeable to particles. Indeed, there is good reason to construct it as a solid screen because fast neutrals may try to exit the device. If they then impact a solid outer screen then re-ionisation may occur and those particles will be accelerated by the field between S1 and S2 and will re-enter the device, though this construction also means sputtered materials from the solid S1 screen may also enter the device and create contamination.

The exit of fast neutrals present a problem for the embodiments of the present invention so far described. The efficiency of a device that is built for the purpose of net fusion energy gain may be compromised if due regard for the mean free path of ions and neutrals is not considered, namely that the distance between the outer electrodes and the inner screen should be greater than a few times the mean free path of the neutrals. Fast neutrals carry away energy that the recycling processes in the present invention seek to mitigate. Therefore, it may be important to try to get them to re-ionise before reaching the inner screen if maximum efficiency and scattering losses are to be controlled.

Further, the mean free path of ions should be comparable with the circumference of the stability orbit, so as to ensure that ions in the process of recovery into the circular beam are not scattered repeatedly, which would lead to a population of such ions never recovering into the beam.

These conditions therefore set some requirements on the gaseous pressure inside a device embodying the present invention. Generally, an embodiment whose dimensions are of the order of 10 s of centimeters would require a working background pressure in the order of microns ($10^{-3}$ mbar).

This specification of the present invention does not seek to provide solutions to this issue of evacuation or gaseous porting of such a device to the required operating pressures. Similarly, nor has it covered the many issues relating to electrical interconnections, electrical isolation, high voltage stand-offs nor magnetic components that would be inevitably required to realise and construct a device embodying the present invention. However, these issues are generally know in the field and anyone skilled in vacuum devices and plasma equipment will be able to design and construct a device embodying the present invention. Some aspects, such as the problems associated with using neutron resistant materials as may be necessary within a DD fusion device, are similarly well known though the state of the art in this field is not well developed because no devices have yet demonstrated a continuous fusion reaction at a rate that causes complications in this regard.

An evolution to the embodiments described so far is to mate two such systems together. That is, there are two 'central' electrodes, two sets of outer electrodes and, thus, two possible stable orbits that ions can adopt. FIG. 12 is a section view through the orbital planes of such a device. Here, outer electrodes C1, C2, C3, and then C5, C6 and C7 form two sets of electrodes, each set being 3 electrodes that would otherwise be 4 outer electrodes (any number, 2 or more, may be used per side of this device, as previously discussed in regards other embodiments). One of the '4 electrodes' is removed, when compared with the previous embodiments, so that two such sets of electrodes can then be positioned next to each other. Ions entering the rotating electric fields generated within each set, in the same way as previously described, will rotate through 90° of azimuth, in each rotation, without an outer electrode. The intention in this embodiment is to cause the two beams, so formed, to come into the same space at the centre of the device. Because the magnetic fields, '~B', are generally in the same direction so the rotation in both halves of the device are in the same direction. This means that they come together 'head-to-head' at the centre.

The complication for this configuration is that if the magnetic fields were axisymmetric about each central electrode, then ions would take up a tighter radius in the central region of the device as there is no opposing electric field. This would put them on an orbit away from the stability orbit and the system would not maintain circular beams. To correct this, the magnetic fields must be designed so that the magnetic field strength backs off during the ions' transit through the azimuthal angles without electric field opposition to the magnetic field. At the centre of the device, the field strength is that required for cyclotronic orbiting, at the operating speed w. FIG. 13 shows a section view across the device orthogonal to the prevailing magnetic fields. The field at the centre of the device, B2, is arranged so that it takes advantage of the fringing effects between the magnets, H1, H2, H3 and H4 and is lower at that point by the required amount.

This configuration means that the collision rate becomes less dependent on the background density but more dependent on the beam currents being held, and so background pressure, and thus scattering losses with background neutrals, can be better optimised for system efficiency. Also, the kinetic energy of the beam ions can be reduced by a factor of 4 in the case of identical beam and target particle masses due to the reduced mass and increased velocity in the inertial frame of the collision. This makes it significantly easier to construct electric and magnetic fields of adequate strength.

It is also conceivable that the embodiment shown in FIGS. 12 and 13 need not be symmetrical between the groups of electrodes, that is either side of the central region of collision of the beams. Instead, altering the geometry asymmetrically may mean that differing species of ions can be captured by, and held in, separate circular beams and, thus, caused to collide selectively.

Another evolution to the embodiments so far discussed is to use the central electrode as a means to generate ions. Generally, free electrons generated in ionisation events between the beam ions and background neutrals will undergo ExB drift between the central electrode and the outer electrode, and also between the outer electrodes and the inner screen, and in doing so will further ionise neutrals in those regions. For this reason, an ionisation source is not generally required. However, where a device using the principles of the present invention is used to perform tasks that a cyclotron may be used for, continuous ionisation of a substance admitted in a controlled manner to the centre of the device may be required and this would necessitate a particular means to do so. This can be incorporated easily in the present invention by operating a current through the central electrode so that it gets hot and it releases ionising electrons by thermionic emission. Optimum materials for this purpose are well-known. To avoid reacting with the magnetic field, a high frequency alternating current should be used to heat it in preference to a DC current. Alternatively, a co-axial double-skinned central electrode can be constructed in which the two skins are electrically conductive but isolated, and where the outer is permeable to ions, and where its geometry (such as inwardly directed sharp prominences protrude from it towards the centre conductor, or simply where it has a much smaller surface area than the inner conductor) promotes positive coronal discharge around the outer skin, when held at a suitable potential to each other, such that ions formed about it are then accelerated out by the radial electric fields. The latter configuration will increase the diameter of the central electrode which may be then significantly bombarded by circulating ions, and may not necessarily be suitable where high efficiency or high beam currents are required.

The present invention lends itself to resolving the relativistic issues with the cyclotron. FIG. 14 shows this graphically. In a non-relativistic cyclotron there is a constant match between the centripetal acceleration on a charged particle and the magnetic force generated on it due to its velocity. This relationship breaks down as the particle gains mass due to a relativistic velocity. The present invention offers a resolution to this by applying a stabilising radial electric field which allows the magnetic field to be set at the required strength for relativistic particles, with the electric field providing a balancing force to counter that of the magnetic force. As velocity increases to relativistic speeds so the magnetic force becomes more dominant, whilst the electric field force remains constant and therefore becomes relatively less important. The strength of the magnetic field and electric fields can be set so that the force provided by the net combination of those just matches that required at some given relativistic speed, as shown graphically in FIG. 14. In this way, the force provided and the force required can be tuned and matched according to the desired terminal kinetic energy for the particle.

Removing beam particles from a device embodying the present invention would be much the same as a conventional cyclotron, except for the fact that there is generally no need for an extra radial deflection electrode as such structures would already exist. A controlled pulse of higher, exit, voltage to momentarily pull the beam onto a bigger radius is required. This is similar to the cyclotron. A hole in the outer screens must be engineered at a suitable location (if used—for cyclotron operation the outer screens are not essential but may aid operational efficiency or may be necessary for EMC reasons). FIG. 15 shows such a system. The internal structures are as previously labelled in the other figures with the addition of a tube, 'D' (viewed in section), which may be held at a suitable voltage to pull the beam through and eject it into further beam conditioning apparatus.

The present invention relies on charged particles experiencing both magnetic and electric field forces so if the density is too high then a plasma may form within the device with a Debye screening distance which would prevent the ions in the plasma from being controlled by the electric fields. Other conditions may also lead to such a plasma forming, which is generally detrimental to the principles of the present invention. However, it is also conceivable that certain configurations of the apparatus embodying the invention may be equally capable of confining a plasma, providing the plasma itself becomes as the central electrode of the present invention.

In a plasma-electrode embodiment of the invention, a particular volume of the device would be occupied by a 'plasmoid', but otherwise outside that plasmoid the electric field would be generally as for a vacuum. This could be devised by, for example, operating a large current axially through the device and using the conducting plasma to generally replace the central electrode (two physical electrodes must remain at either ends of that plasmoid to act as electrodes to feed current into it). It is well-known in fusion energy research that a large current through a plasma tends to confine it radially due to the magnetic field it generates, but to generate the fields necessary to contain plasmas of sufficiently high temperature for fusion the currents must be considerable, of the order of millions of amperes. Experimentally, this combination of high temperature plasma and high currents have proved impossible to stabilise in linear systems and research into it has generally favoured the 'tokamak' designs. However, the present invention offers a mechanism that may help stabilise such a plasma. If a high current, high temperature plasmoid acts as a central electrode in the present invention, the magnetic field of the plasma itself can only drift if the particles that constitute it drift, and if there are outer electrodes operating in the manner already well described, any individual particles at the surface edge of the plasmoid, or on an exit trajectory, will be acted on by the magnetic and electric forces to take it back to its designed orbital radius. It may then be expected that the plasmoid will expand into the space up to the stability radius, R, but any particles that try to diffuse further than that will be returned back towards the edge of that plasmoid, thereby stabilising it. For tokamak applications, radial electric fields may be caused to rotate poloidally around its plasma, by the methods of the present invention. In this way, particles may be confined to the edge of the plasma and undertake closed poloidal orbits, FIG. 8 depicts electrodes in an example configuration suitable for a toroidal configuration. in which spiral electrodes C1 to C4 cork-screw around a toroidal surface that encloses an electrode, A, which could be an inductively generated toroidal plasma electrode, and where the poloidal extent of the plasma is then defined by the stability radius.

FIG. 16 depicts example ion paths near to the boundary edge of the plasma of a plasma-electrode embodiment. Ion I1 is shown to approach the edge, from within the plasma, where it comes under partial influence of external radial electric fields before returning deeper into the plasma. Ion I2 follows a path that takes it closer still to the edge and is accelerated, by the methods described herein. It might continue in that path if not for collisional drag and damping phenomena with the plasma that cause it to slow, tightening its gyro-radius on a path back into the plasma. Ion I3 is performing near complete orbits, grazing the edge of the plasma electrode, P, under the influence of the radial fields, but also experiences drag causing its return into the plasma. Ion I4 completes a closed orbit of P. Ion I5 is on a path that exits P but does so at an azimuth between a charged electrode (indicated by four '-ve' signs) and a partially discharged one (indicated by a single '-ve' sign), which leads to restoration of that ion's orbit back towards the plasma edge, by the processes described herein. Ion I6 has emerged from the plasma at an azimuth where the fields are not favourable for recovery of the ion, and is lost. The electrodes may be of solid construction, though more of the lost ions may be recovered if 'transparent' electrodes or screens, as described herein, are used. Without the rotating fields of the present invention, a 'Penning' type confinement, with static radial electric fields, may still form incidentally in a device where a plasma within it adopts a potential with respect to the walls of the device, such that ions in the edge would have stability against small perturbations but not necessarily against outward scattering. With neither static nor rotating radial electric fields of sufficient magnitude, there may be little intrinsic stability or recovery of any perturbed ions in the edge, so the plasma may diffuse and form no distinct plasma boundary at all (limited only where it contacts a solid structure). In a toroidal device the magnetic field would be strongest towards the 'inside' curve so, for example, if FIG. 16 is taken to be a poloidal cross-section and the electrodes C2 & C3 were on the 'inside' of a toroid, then the view of ion paths would tend to be correctly oriented. For linear devices described here (viz. two electrodes at distal ends driving a pinching current) the plasmoid would be nominally axisymmetric, so the pattern of ion paths would tend to rotate with respect to the electric fields.

The plasmoid of a plasma-electrode embodiment will acquire an angular momentum resulting from the angular momentum gained by the returning particles whilst undergoing acceleration and manipulation in the radial e-fields. Such a rotation would tend to assist plasma to flow into lower magnetic flux regions and if there is sufficient fringing at the axial extents of a linear system then it will tend to draw the plasmoid away from the material structures of the distal ends of the device, thereby insulating it further against thermal energy losses.

The magnetic fields required for this need to be much stronger than previously discussed, however. The energy required to displace a particle against the correcting force, $\Delta r[Bqw-mw^2]$, is the integral of that function such that $2E=[Bqw\Delta r^2-mw^2\Delta r]$ and for a deuteron of energy 20 keV means that for $\Delta r$ to be around 1 cm so B must be around 10 T in a device of the order of 10 s of centimetres in size. These are onerous conditions to engineer for, but have been previously achieved experimentally.

In regards to external screens, as this embodiment is generally aimed at confining particles into a plasmoid within the stability radius R, there is no aim to recycle particles. However, if the use of outer screens can add a small efficiency then the innermost screen should be at the same electrical potential as one of the electrodes driving the current through the plasma. It clearly cannot be connected to both electrodes driving the plasmoid current else the screen itself would take that mega-amperage current. The voltage difference across the plasma is not likely to cause much distortion to the radial electric fields because the resistance in the plasma at fusion temperatures is essentially zero so particles will essentially see the plasmoid at a uniform potential.

A plasmoid which is formed for the purpose of acting as the central electrode need not be generated by a high axial current, but could also conceivably be formed as the 'positive column' of a gas discharge between a solid central electrode and the outer electrodes, that is, apparatus as per the previous embodiments. In this case, it can be expected that this gas discharge plasmoid would tend to rotate along with the rotational charging cycles of the outer electrode, as it is their potential that forms the gas discharge, and it may acquire thermal energy by collision interactions with the background medium, if not by inputted energy. The same considerations of high magnetic fields apply and the boundary between the positive column and the Faraday dark space of this discharge (where there is a lack of positive ions) may also be expected to extend up to the stability radius R. Steep electric field gradients may be found between this region, up to the cathode, that would ordinarily accelerate positive ions through to the cathode, which is therefore a compatible configuration with the principle of the present invention.

The benefit of employing a plasmoid as the central electrode is that the operating pressure of such a device would be considerably higher than that of a beam device (and necessarily so to form such plasmoids) which would improve reaction rate and mean that 'scattering losses' within that plasma no longer apply because the particles are thermalised, the disadvantages being that the plasmoid could not reach the very high particle energies achievable by the beam process (which may otherwise permit access to 'advanced' fusion reactions such as p+7Li, p+11B, p+15N, 3He+3He) and that electromagnetic radiation losses may be higher and require a direct energy input to compensate.

The invention claimed is:

1. A method of accelerating and manipulating charged particles into closed orbits by subjecting them to crossed magnetic and electric fields comprising the steps of, i) providing generally radial non-axisymmetric electric fields by applying differential electrical potentials to a central electrode and a series of outer electrodes, and ii) providing means to produce a magnetic field generally orthogonal to the electric fields, then iii) causing the rotation of the electric fields by the charging and discharging, or partial discharging, of the outer electrodes in a synchronous manner.

2. The method of claim 1 in which the phase, frequency and duty cycle of the synchronous charging and discharging. or partial discharging, of the outer electrodes and the minimum and maximum electric potential differences in those cycles are fixed, or manually, or automatically adjusted according to the required magnitude and rotational velocity of the electric fields such that charged particles of a particular charge to mass ratio are accelerated and manipulated towards a particular orbit.

3. The method of claim 1 in which the charged particles are accelerated and manipulated into closed orbits about a particular axis where those closed orbits come into proximity with other charged particles also accelerated and manipulated into closed orbits but that are centred about a second axis, such that charged particles in closed orbits about one axis may collide with charged particles in closed orbits about the other axis.

4. The method of claim 1 in which means are provided to form the central electrode, or part of the central electrode, from a plasma and where charged particles in the outer edge of the plasma experience prevailing radial electric fields between the plasma and the outer electrodes, such that charged particles in the edge of the plasma may be confined into a determined closed orbit and speed thus confining the plasma.

5. The method of claim 1 in which the synchronisation of the charging and discharging. or partial discharging, of the outer electrodes comprises the steps of forming the electric fields with a central electrode and 4, or multiples of 4, outer electrodes and then connecting the outer electrodes to electrical power supply equipment driven by the logical outputs of 8 NOR electronic logic gates, connected as to form a sequence of 4 inter-connected flip-flops whose collective state cycles through four discrete states.

6. The method of claim 1 in which the charged particles are permitted, and/or admitted, into the electric fields.

7. The method of claim 1 in which a media is admitted and/or permitted into the electric fields so that it may become ionised and liberate the charged particles.

* * * * *